US006987940B2

(12) United States Patent
Tamura

(10) Patent No.: US 6,987,940 B2
(45) Date of Patent: Jan. 17, 2006

(54) DEVELOPING APPARATUS

(75) Inventor: Masashige Tamura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/421,775

(22) Filed: Apr. 24, 2003

(65) Prior Publication Data

US 2003/0202823 A1 Oct. 30, 2003

(30) Foreign Application Priority Data

Apr. 30, 2002 (JP) ..... 2002-129302
Apr. 30, 2002 (JP) ..... 2002-129317

(51) Int. Cl.
*G03G 15/01* (2006.01)

(52) U.S. Cl. ..... 399/227; 399/119; 399/120; 399/264

(58) Field of Classification Search ..... 399/107, 399/111, 112, 119, 120, 227, 262, 264
See application file for complete search history.

(56) References Cited

U.S. PATENT DOCUMENTS

| | | | | |
|---|---|---|---|---|
| 5,508,794 A | | 4/1996 | Ikesue et al. | |
| 5,752,141 A | | 5/1998 | Nishimura et al. | 399/227 |
| 5,838,456 A | * | 11/1998 | Wagi et al. | 358/300 |
| 6,336,020 B1 | * | 1/2002 | Ishikawa et al. | 399/227 |
| 6,625,414 B2 | * | 9/2003 | Izumi | 399/227 |

FOREIGN PATENT DOCUMENTS

| | | |
|---|---|---|
| JP | 6-308829 | 11/1994 |
| JP | 9/218575 | 8/1997 |
| JP | 10-142888 | 5/1998 |
| JP | 11-65248 | 3/1999 |
| JP | 11-249418 | 9/1999 |
| JP | 2000-66500 | 5/2000 |

* cited by examiner

*Primary Examiner*—Hoang Ngo
(74) *Attorney, Agent, or Firm*—Fitzpatrick, Cella, Harper & Scinto

(57) ABSTRACT

A developing device having a plurality of developing devices for developing an electrostatic image formed on an image bearing member by a developer including a toner and a carrier, a rotary member carrying the plurality of developing devices therein and rotated in a route including a developing portion, a discharging port provided in each of the plurality of developing devices for discharging any excess developer therethrough with the supply of the developer to the developing device located in the developing portion, a collecting pipe provided in the rotary member for collecting therethrough the excess developer discharged from the plurality of developing devices, and a communicating tube for linking the discharging port and the collecting pipe together, the communicating tube being made into a slope shape from the discharging port toward the collecting pipe, wherein when the developing devices are located in the developing portion, the discharging port is located above the collecting pipe.

10 Claims, 14 Drawing Sheets

FIG. 5B
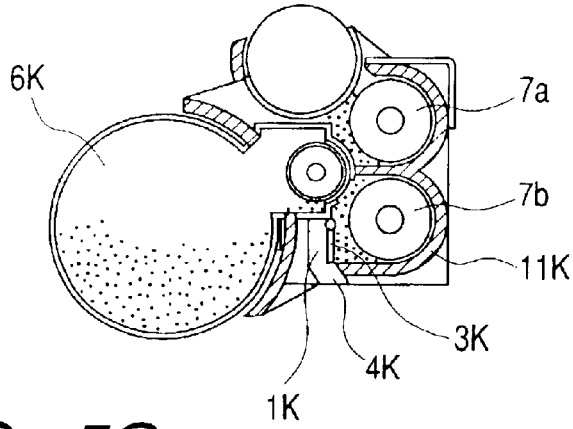
FIG. 5A
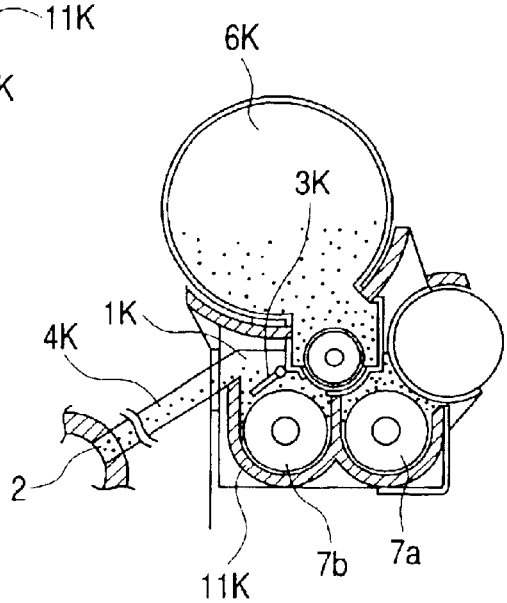
FIG. 5C
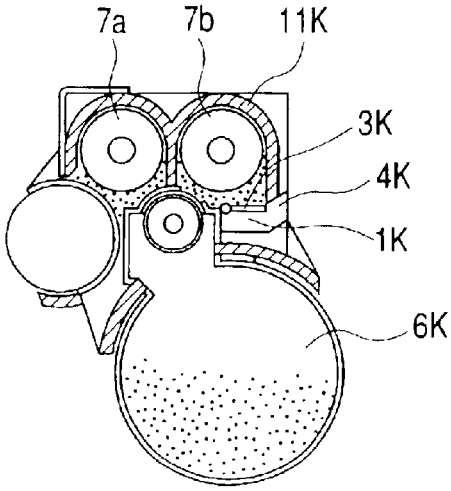
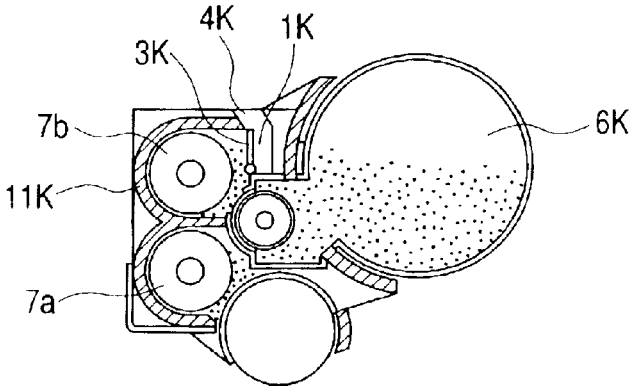
FIG. 5D

FIG. 13B
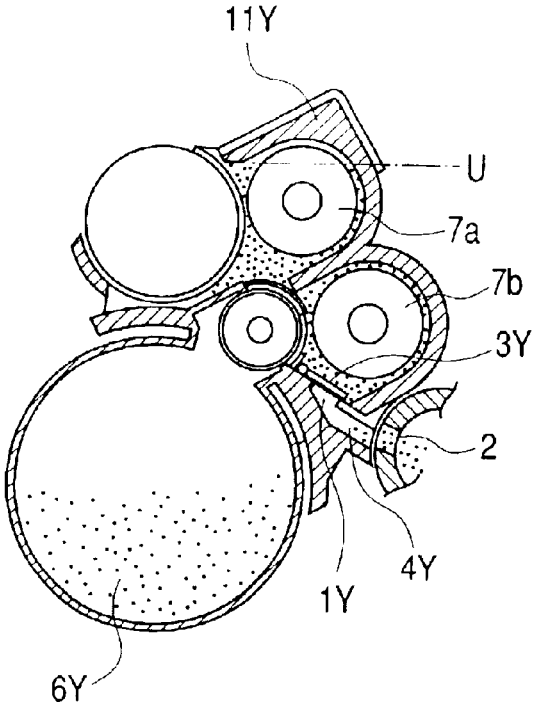
FIG. 13A
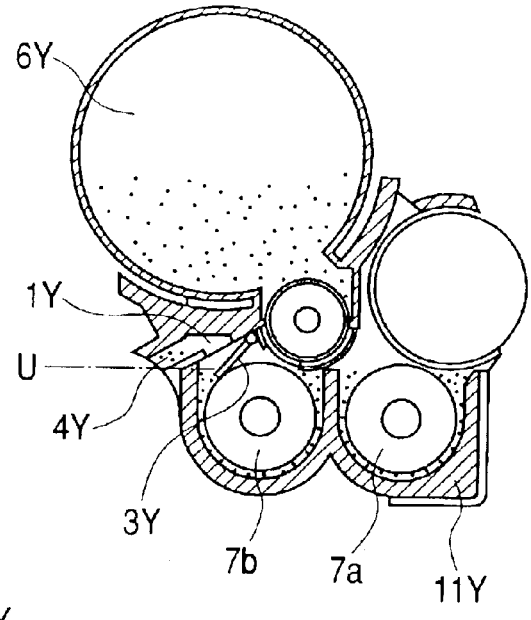
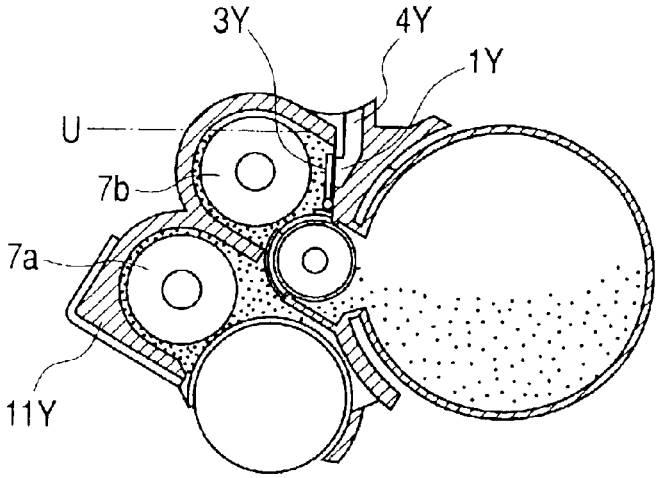
FIG. 13C

FIG. 14B
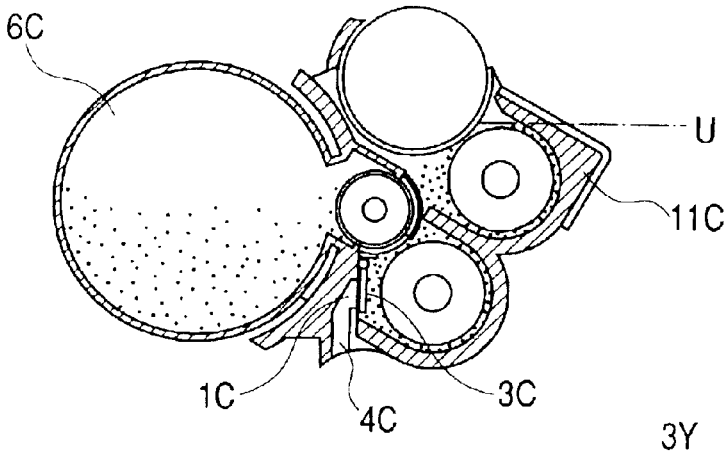
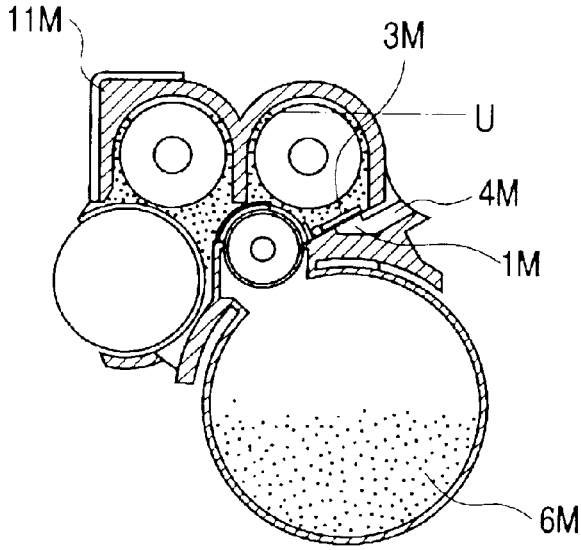
FIG. 14C
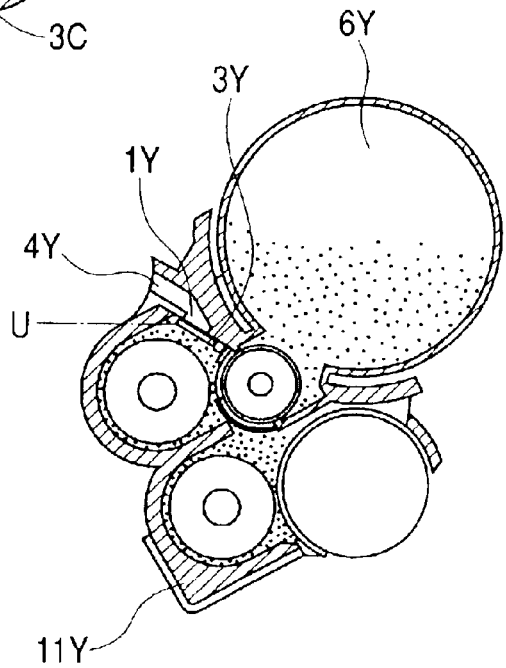
FIG. 14A

DEVELOPING APPARATUS

BACKGROUND OF THE INVENTION

1. Field of the Invention

The invention relates to a developing apparatus for use in a copying machine, a printer, a facsimile apparatus or the like using an electrophotographic process or an electrostatic recording process.

2. Description of Related Art

Heretofore, in multi-color image forming, use has been made of a technique of forming a plurality of colors of toner images successively, for example, on an electrophotographic photosensitive member (photosensitive member) which is an image bearing member, and successively or collectively superimposing the plurality of colors of toner images onto a transfer medium such as recording paper.

In such a multi-color image forming apparatus, there has heretofore been proposed and put into practical use a so-called rotary developing process of mounting developing devices for black, yellow, magenta and cyan, for example, on a rotary type developing member, and rotating this rotary type developing member to thereby successively move the necessary developing devices to a developing position opposed to the photosensitive member which is the image bearing member and perform a developing operation.

On the other hand, in image forming apparatuses of a conventional electrophotographic type or electrostatic recording type, above all, particularly in a multi-color image forming apparatus for effecting colored image forming, use has widely been made of a two-component developing process using chiefly a mixture of a nonmagnetic toner and a magnetic carrier as a developer. The two-component developing process, as compared with other developing processes being proposed at present, has merits such as the stability of image quality and the durability of the apparatus. On the other hand, in the two-component developing process, the deterioration of the developer due to a long period of endurance, particularly the deterioration of the carrier, has been unavoidable and therefore, with the long period of use of the apparatus, the work of interchanging the developer has become necessary, and this has brought about an increase in service cost and running cost.

Several methods of solving such a problem have heretofore been proposed. For example, there is a developing device loaded with an interchangeable developer supplying cartridge to thereby effect the supply of a developer including a toner and a carrier, and the collection of the developer (see Japanese Patent Application Laid-Open No. 6-308829).

In this developing device, however, there is adopted structure using a plurality of screws to collect the developer overflowing from the developing device into the developer supplying cartridge and therefore, the apparatus becomes large-scaled, and a control mechanism also becomes complicated. Also, when the developing device of such a construction and the developer supplying cartridge are carried on a rotary type developing member, the diameter of the rotary type developing member becomes large and the apparatus becomes bulky. Further, a developer conveying route is complicated, and when the rotary type developing member is rotated, the developer may leak.

So, particularly in the rotary developing process, there has been put into practical use a developer discharging process of utilizing a change in the acting direction of gravity resulting from the rotational motion of the rotary type developing member to supply a two-component developer to the developing device, and discharge the two-component developer from the developing device.

For example, Japanese Patent Application Laid-Open No. 9-218575 discloses a rotary developing process designed such that as shown in FIG. 6 of the accompanying drawings, a developer including an amount of toner consumed by a developing operation at a developing position P1 opposed to a photosensitive drum 201 is supplied to a developing device 210, and any excessive developer in the developing device 210 is discharged to a developer cartridge 220 through a discharge port 221, a transport tube 222 and a collection port 223 by the utilization of a change in the acting direction of gravity by the rotation of a rotary type developing member 204. That is, this process is simple in structure because movement peculiar to the rotary type developing member 204 is utilized to effect the supply and collection of the developer, and a reduction in charging capability for a carrier is prevented without causing the bulkiness and a rise in the cost of the apparatus.

On the other hand, Japanese Patent Application Laid-Open No. 10-142888 discloses a rotary developing process designed such that as shown in FIG. 7 of the accompanying drawings, a developer discharged from a developing device 310 through a discharge port 321 at a developing position P1 whereat the developing device 310 is opposed to a photosensitive drum 301 is temporarily stored in a storing portion 322, and by the utilization of a change in the acting direction of gravity by the rotation of a rotary type developing member 304, the developer in the storing portion 322 is transported to a cylindrical shaft 323 at the center of the rotary type developing member 304 through a collection port 323*a*, and is finally collected into a developer collecting container (not shown) at an end portion of the cylindrical shaft 323 by a developer transporting member 323*b* in the cylindrical shaft 323. That is, as in an image forming apparatus proposed in Japanese Patent Application Laid-Open No. 9-218575, movement peculiar to the rotary type developing member 304 is utilized to effect the discharge of the developer. Therefore, a reduction in charging capability for a carrier is prevented without causing the bulkiness of the apparatus. In addition, design is made such that even when single-color image forming is continued, the developing operation is not stopped, but at the developing position, the excessive developer in the developing device 310 is discharged to the storing portion 322 outside the developing device 310 and therefore, the lowering of image productivity is suppressed to a certain extent, and the amount of developer in the developing device 310 is maintained within an allowable value.

The above-described examples of the conventional art, however, have suffered from the following problems.

In the midst of recent years when the market of full-color copying machines/printers has been enlarged and various functions are required, there have been commercialized many image forming apparatuses having been downsized and reduced in cost, and yet seeking for high image productivity, and this seems to become one of the mainstreams of the market in the future, too.

In the image forming apparatus described in the above-mentioned Japanese Patent Application Laid-Open No. 9-218575, the rotational motion of the rotary type developing member 204 is utilized to discharge the deteriorated developer to the developer cartridge and therefore, structure is simple and the bulkiness and high cost of the apparatus are not caused and the deteriorated developer is gradually replaced with a fresh developer, to thereby stabilize the characteristic as the whole of the developer. Therefore, the interchange of the developer becomes unnecessary and maintenance property is improved. However, at the developing position P1, the excessive developer in the developing device 210 is not discharged to the outside of the developing device 210 and therefore, particularly when single-color high density images are continuously formed, in order to prevent any increase in the amount of developer in the developing device 210, the developing operation must be stopped in spite of images being formed and the operation of discharging the developer, i.e., the operation of rotating the rotary type developing member 204, must be performed, and a great reduction in image productivity could not be avoided.

On the other hand, in an image forming apparatus described in the above-mentioned Japanese Patent Application Laid-Open No. 10-142888, the deteriorated developer is discharged into the collecting container provided at an end portion of the cylindrical shaft 323 of the rotary type developing member 304 and is gradually replaced with a fresh developer to thereby stabilize the characteristic as the whole of the developer. Thus, the interchange of the developer becomes unnecessary and maintenance property is improved and in addition, design is made such that at the developing position P1, the excessive developer in the developing device 310 is discharged to the storing portion 322 outside the developing device 310 and therefore, during continuous single-color image forming, the developer can be stably discharged without the rotary type developing member 304 being rotated up to a certain degree of amount of excessive developer discharge. Accordingly, within the allowable range thereof, image productivity is not lowered due to the developer discharging operation.

Again in this image forming apparatus, however, as in the image forming apparatus described in the above-mentioned Japanese Patent Application Laid-Open No. 9-218575, basically a change in the direction of gravity by the rotative movement of the rotary type developing member 304 is utilized to discharge the developer to the collection port 323*a*, and make the developer fall and therefore, when the discharged developer is too much stored in the storing portion 322 (exceeds the aforementioned allowable range), the discharging operation cannot be performed any further.

Therefore, particularly when single-color high-density images are continuously formed, in order to prevent any increase in the amount of developer in the storing portion 322, the developing operation must be stopped in spite of images being formed, and the operation of discharging the developer, i.e., the operation of rotating the rotary type developing member 304, must be performed. Thus, a great reduction in image productivity could not be avoided.

Also, the storing portion 322 must be discretely provided in the developing device 310 and therefore, a plurality of members unnecessary for ordinary image forming must be provided, and the complication and a rise in the cost of the apparatus could not be avoided.

Now, heretofore, in image forming apparatuses of an electrophotographic type having a rotary type developing member, there has often been seen a construction in which a developer bearing member provided in a developing device is made to wait at a phase position (so-called home position) in which it is not opposed to a photosensitive member so that when an image forming operation is not being performed, the photosensitive member may not be adversely affected by the strong magnetic force of the developer bearing member provided in the developing device.

Also, when there is adopted a construction in which a developer cartridge comprising a toner bottle is detachably mounted on the rotary type developing member, there is a case where the phase position at which the developer bearing member is stopped and waits in order to interchange the developer cartridge is provided at a phase position discrete from the above-described developing position or home position stop and waiting position.

When such a construction is adopted, besides a "development stopping position" which is the stop position of the rotary type developing member when a developing device for each color is disposed at the developing position, the stop and waiting positions of a plurality of rotary type developing members become necessary. For example, the stop positions of developing device provided in a rotary type developing member holding developing devices for four colors are not restricted to four locations of 90 degrees, 180 degrees, 270 degrees and 360 degrees from the developing position which is at 0 degree, but cannot help having a plurality of stop positions besides them.

However, both of the image forming apparatuses described in the above-mentioned Japanese Patent Application Laid-Open No. 9-218575 and Japanese Patent Application Laid-Open No. 10-142888 are of a construction in which a change in the direction of gravity by the rotative movement of the rotary type developing member is utilized to make the excessive developer fall to the destination of discharge and therefore, as the rotation stopping positions are increased, a discharging mechanism becomes more unstable, whereby there are cases where unexpected discharge is effected, and it becomes difficult to maintain a high quality of image.

Particularly, in the image forming apparatuses having a rotary type developing member, the shortening of a changeover time for this rotary type developing member has been advanced in order to cope with the high productivity in recent years. In this case, the shock force when the rotation of the rotary type developing member is started and stopped tends to become great, but in other rotation modes than a continuous image forming operation, it is often the case that an acceleration and deceleration curve is set to a slow one in order to make the shock force small. When as described above, the image forming apparatus has a rotation mode for a plurality of rotary type developing members, the instability of a discharging mechanism resulting from the above-described increase in the rotation stopping positions tends to be further promoted.

This is because during a continuous image forming operation, the aforedescribed development stopping position visits periodically and stably, whereas the "home position waiting position" is for stopping and waiting only after the termination of a job and the "developer cartridge interchange stopping and waiting position" is for stopping and waiting only when the toner in the cartridge has become little. If an attempt is made to include all these conditions and obtain a stable discharge characteristic of the developer, it has required much difficulty in setting the conditions.

That is, in the conventional art, the work of interchanging the developer becomes unnecessary and maintenance property is improved, but it is difficult to obtain a stable high image quality maintaining characteristic, and particularly taking into account a case where single-color high-density images continue or the like, it has been very difficult to realize all of the simplification and reduced cost of the apparatus and high image productivity at a time.

SUMMARY OF THE INVENTION

It is an object of the present invention to provide a developing apparatus, which can realize a high maintenance property and high image productivity by a simple construction.

Further objects of the present invention will become apparent from the following detailed description when read with reference to the accompanying drawings.

BRIEF DESCRIPTION OF THE DRAWINGS

FIGS. 5A, 5B, 5C and 5D are illustrations for illustrating a developer discharging operation.

FIGS. 13A, 13B and 13C are illustrations for illustrating an example of the rotated state of a rotary developing device according to the present invention.

FIGS. 14A, 14B and 14C are illustrations for illustrating another example of the rotated state of the rotary developing device according to the present invention.

DETAILED DESCRIPTION OF THE PREFERRED EMBODIMENTS

A rotary type developing member and an image forming apparatus according to the present invention will hereinafter be described in detail with reference to the drawings.

Embodiment 1

Figure 1:
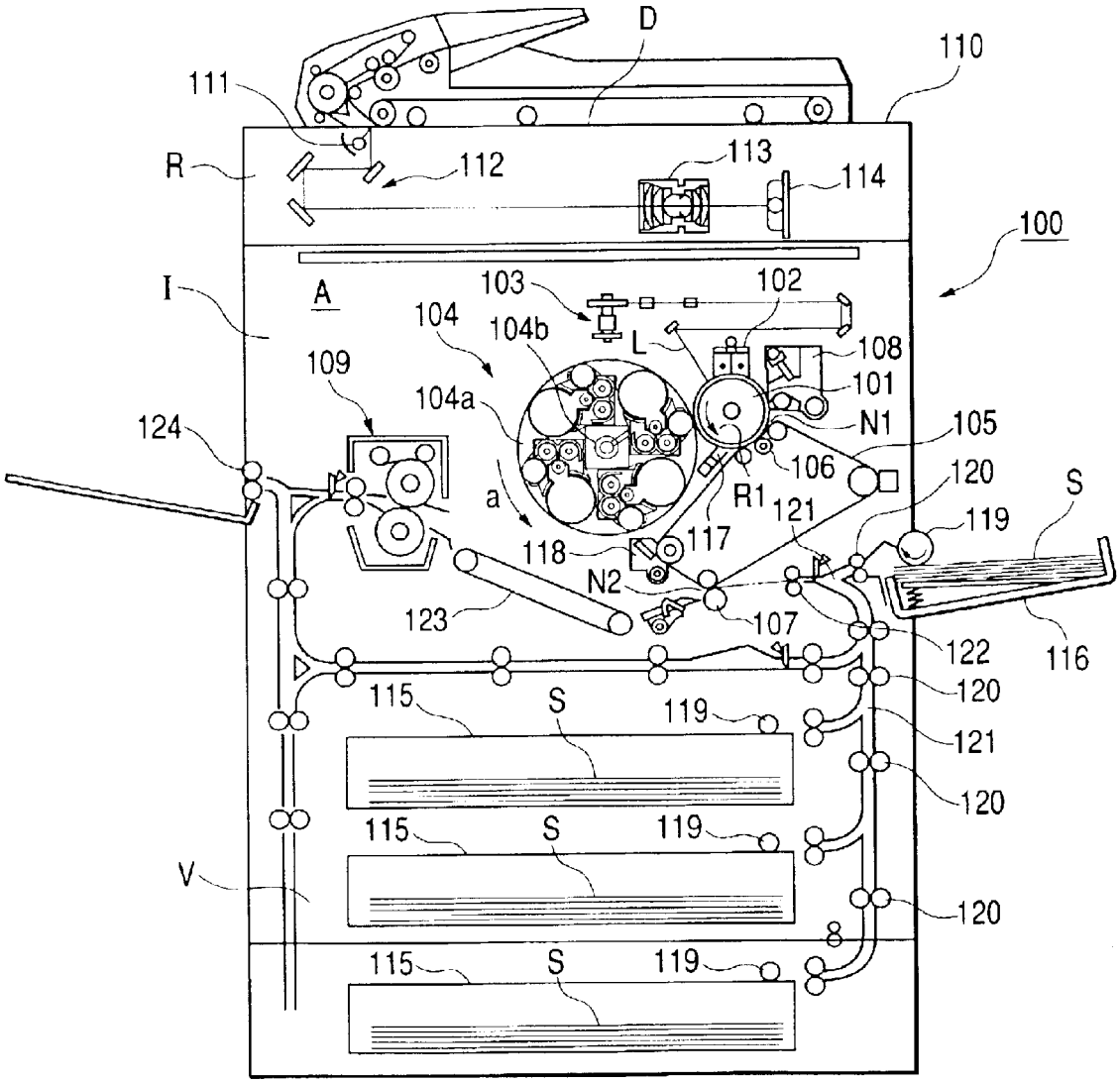
FIG. 1 is a schematic cross-sectional front view of an image forming apparatus according to Embodiment 1.

FIG. 1 shows a schematic cross-sectional view of an embodiment of the image forming apparatus according to the present invention. The image forming apparatus 100 of the present embodiment is a multi-color image forming apparatus (color copying machine) provided with a rotary type developing member.

The image forming apparatus 100 of the present embodiment has a rotary developing device 104 which is a rotary type developing member most characteristic in the present embodiment. Also, an image forming apparatus main body (apparatus main body) A is provided with a reader portion R provided with an original supporting stand 110, a light source 111, a mirror system 112, a lens system 113 and a CCD unit 114, a paper feeding portion V, an image forming portion I, etc. The paper feeding portion V has cassettes 115 and a manually feeding cassette 116 containing transfer materials S such as recording sheets or OHP sheets therein and detachably mountable on the apparatus main body A, and the transfer materials S are supplied from these cassettes 115 and the manually feeding cassette 116.

In the image forming portion I, there are disposed a cylindrical electrophotographic photosensitive member, i.e., a photosensitive drum 101 as an image bearing member, a primary charging device 102 as charging means for charging the photosensitive drum 101, a rotary developing device 104 (FIG. 2) containing therein a plurality of developing devices (developing means) 11 made integral with one another by a developer cartridge 6 being mounted thereon, a post-charging device 117 for adjusting the quality of an image after being developed, an endless ring-shaped transfer belt 105 which is an intermediate transfer member for superimposing and transfer-forming, for example, toner images of four colors, and thereafter transferring a multi-color image to the transfer material S, a drum cleaner 108 for removing any toners (untransferred toners) residual on the photosensitive drum 101 after the transfer, a secondary transfer roller 107 as secondary transferring means for transferring the toner images from the transfer belt 105 to the transfer material S in a secondary transferring portion N2, a belt cleaner 118 for removing any untransferred toners on the transfer belt 105, etc. The transfer belt 105 is passed over a plurality of rollers and is endlessly moved. At a position opposed to the photosensitive drum 105 with the transfer belt 105 interposed therebetween, there is disposed a primary transfer roller 106 which is primary transferring means for transferring the toner images from the photosensitive drum 101 to the transfer belt 105, and it forms a primary transferring portion N1.

Figure 2:
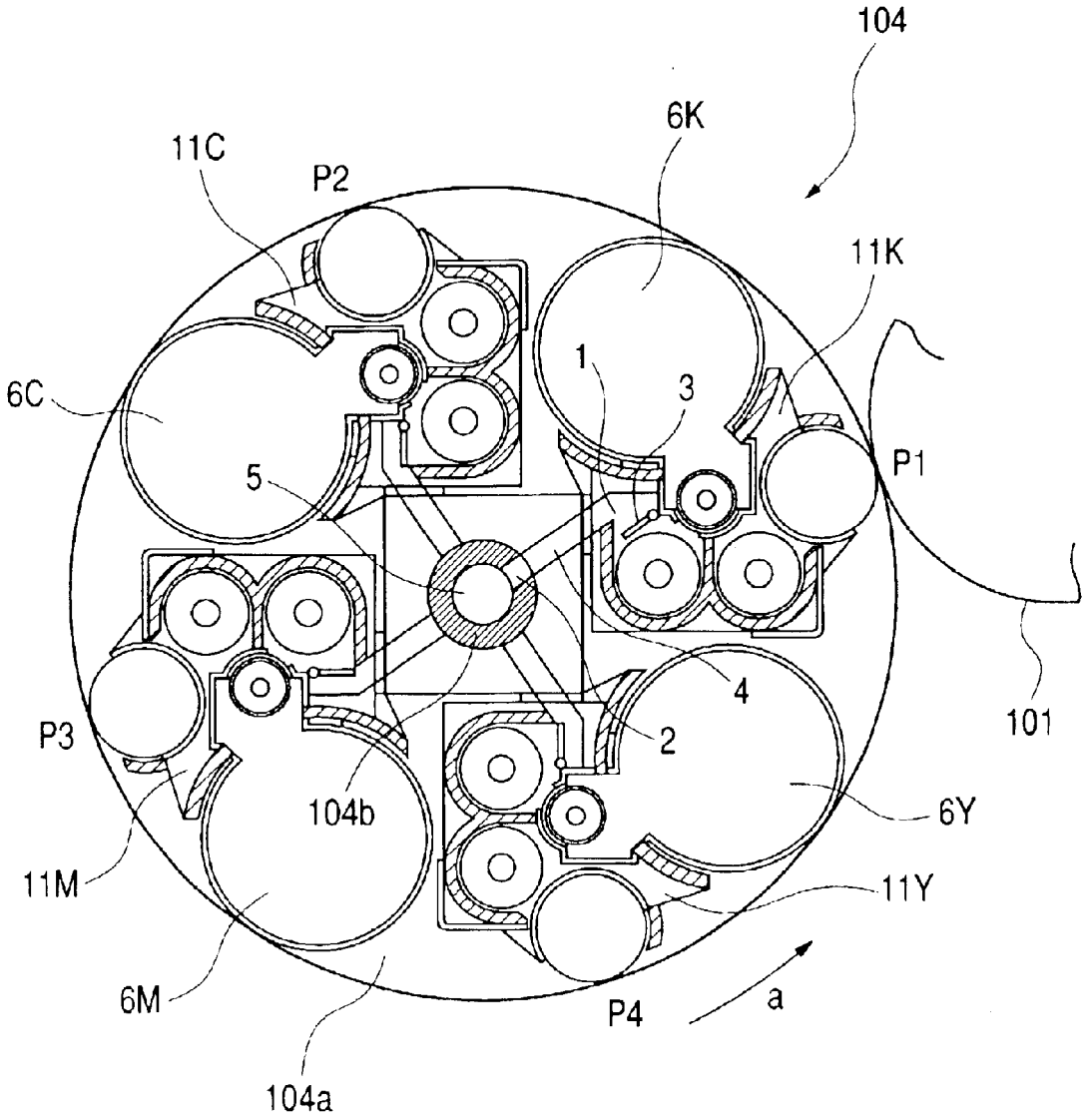
FIG. 2 is a schematic cross-sectional front view of a rotary developing device provided in the image forming apparatus of FIG. 1.

As shown in FIG. 2, in the present embodiment, the rotary developing device 104 has, in a rotary 104*a* which is a rotatable developing device supporting member, developing devices for four developing colors, i.e., a developing device 11K for black, a developing device 11Y for yellow, a developing device 11M for magenta, and a developing device 11C for cyan. The rotary developing device 104 is rotated in the counter-clockwise direction of arrow "a" around a cylindrical rotary shaft (cylinder shaft) 104*b*, and when necessary, moves a developing device for a desired color to a developing position P1 opposed to the photosensitive drum 101.

Upstream of the image forming portion I in the transport route of the transfer material S, there are provided registration rollers 122 for enhancing the posture and position accuracy of the transfer material S supplied from the cassette 115 or the manually feeding cassette 116 in the paper feeding portion V through a pickup roller 119, transport rollers 120 and a transport path 121, and feeding out the transfer material S in timed relationship with the toner images on the transfer belt 105. Also, downstream of the image forming portion I, there are disposed a transporting apparatus 123 for transporting the transfer material S to which the toner images have been transferred, a fixing apparatus 124 for fixing an unfixed image on the transfer material S, delivery rollers 124 for delivering the transfer material on which the image has been fixed out of the apparatus main body A, etc.

While in the present embodiment, the construction of a four-color rotary is shown as an example of the rotary developing device 104, the number of the developing devices carried on the rotary is of course not restricted thereto from the gist of the present invention.

The operation of the image forming apparatus 100 of the present embodiment will now be described. When a paper feed signal is outputted from a control apparatus (not shown provided in the apparatus main body A for generally controlling the operation of the image forming apparatus 100, a transfer material S is supplied from the cassette 115 or the manually feeding cassette 116. On the other hand, light applied from the light source 111 in the reader portion R to an original D placed on the original supporting stand 110 is once read by the CCD unit 114, and thereafter is converted into an electrical signal. This signal is replaced with a laser beam L from a laser scanner unit 103 as exposure means provided in the image forming portion I, and is applied onto the photosensitive drum 101 rotated in the counter-clockwise direction of arrow R1. The photosensitive drum 101 is charged in advance by the primary charging device 102, and an electrostatic latent image is formed thereon by the light being applied thereto. Thereafter, a toner image of a selected color is formed by the plurality of developing devices 11 disposed in the rotary developing device 104.

The toner image formed on the photosensitive drum 101 has its potential adjusted by the post-charging device 117, and is soon transferred onto the transfer belt 105 by the action of a primary transferring bias voltage applied to the primary transfer roller 106 in the primary transferring portion N1. The toner image transferred onto the transfer belt 105, in the case of a color mode, goes toward the primary transferring portion N1 by the transfer belt 105 making one more rotation so that the next toner image may be formed and transferred. In the meantime, the rotary developing device 104 is rotated in the counter-clockwise direction of arrow "a" so that the developing device for the next designated color may be opposed to the photosensitive drum 101, and is prepared to develop the next electrostatic latent image.

Thus, in a full-color mode, the steps of forming and developing an electrostatic latent image and transferring a toner image are repeated until a predetermined image (color) number of toner images have been successively transferred to the transfer belt 105.

On the other hand, the transfer material S fed from the paper feeding portion V has its skew feed corrected by the registration rollers 122, and is further adjusted in timing and is fed to the image forming portion I. Then, by the action of a secondary transferring bias voltage applied to the secondary transfer roller 107, the toner images are transferred from the transfer belt 105 to the transfer material S.

Thereafter, the transfer material S separated from the transfer belt 105 is transported to the fixing apparatus 109 by the transporting apparatus 123, and the unfixed transferred image is permanently fixed on the transfer material S by heat and pressure. The transfer material S on which the image has been fixed is delivered out of the apparatus main body A by the delivery rollers 124.

In this manner, an image is formed on the transfer material S fed from the paper feeding portion V and the transfer material is delivered. Also, any untransferred toners, etc. residual on the photosensitive drum 101 after the toner images have been transferred are removed by the drum cleaner 108, and any untransferred toners, etc. residual on the transfer belt 105 are removed by the belt cleaner 118, and the photosensitive drum 101 and the transfer belt 105 are repetitively used for image forming.

The rotary developing device (rotary type developing member) of the present embodiment will now be further described.

As shown in FIG. 2, in the present embodiment, the rotary developing device 104 has the developing device 11K for black, the developing device 11Y for yellow, the developing device 11M for magenta and the developing device 11C for cyan in the rotary 104*a* which is a rotatable developing device supporting member. The rotary developing device 104 is freely rotatable about the rotary shaft (cylinder shaft) 104*b* by a motor (not shown) as driving means provided in the apparatus main body A.

When for example, a black toner image is first to be formed on the photosensitive drum 101, development is effected by the developing device 11K for black at the developing position P1 proximate to the photosensitive drum 101, and when next, a yellow toner image is to be formed, the rotary developing device 104 is rotated by about 90° in the counter-clockwise direction of arrow "a" in FIG. 2 to thereby dispose the developing device 11Y for yellow at the developing position P1, thus effecting development. When a magenta toner image and a cyan toner image are also to be formed, the rotary developing device 104 is further rotated by about 90° each in a similar manner to thereby dispose the corresponding developing device at the developing position P1, thus effecting development.

When single-color image forming is to be effected, a toner image formed on the photosensitive drum 101 by a developing device containing a desired toner therein is primary-transferred onto the transfer belt 105, and thereafter is immediately secondary transferred onto the recording paper S. Thereafter, the recording paper S stripped off from the transfer belt 105 is transported by the transporting apparatus 123, and is pressurized/heated by the fixing apparatus 124, whereby a permanent image is formed on the surface of the recording paper S. The single-color image forming by this process is higher by four times or so in image productivity than full-color image forming.

Figure 3:
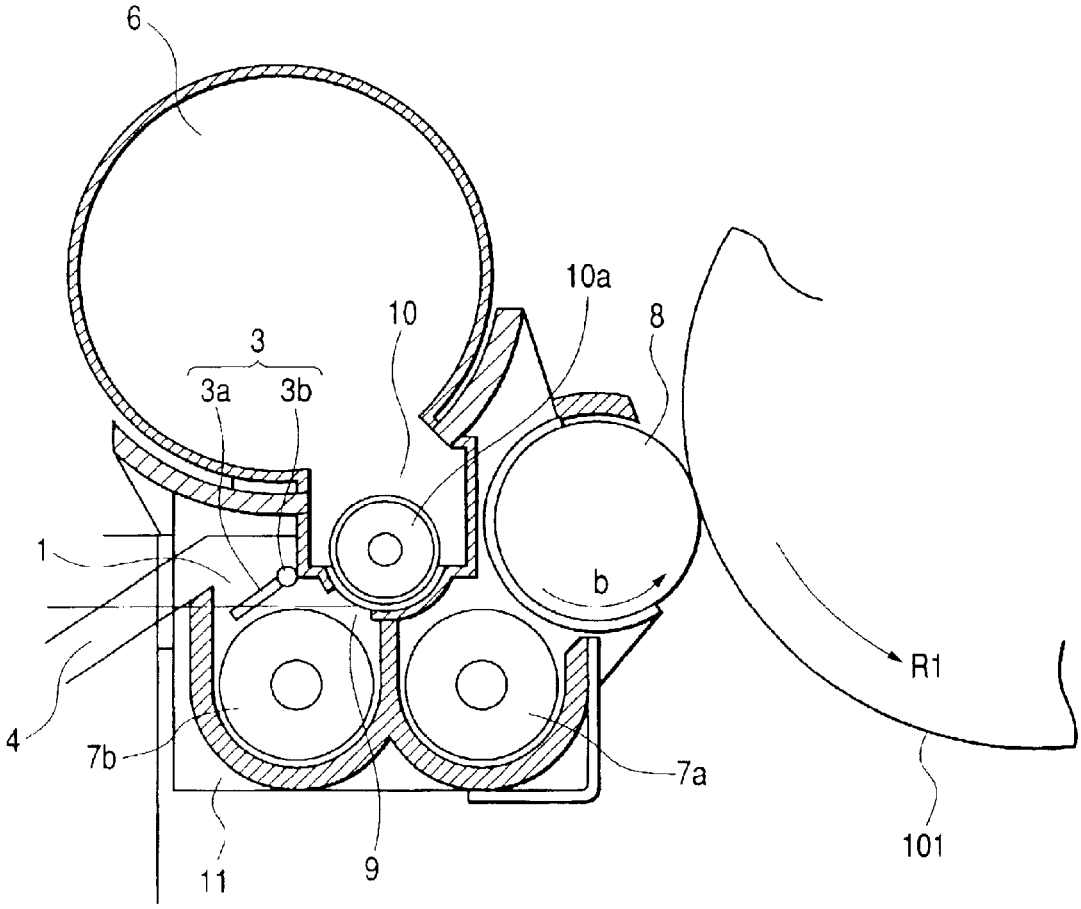
FIG. 3 is a schematic cross-sectional front view of a developing device provided in the rotary developing device of FIG. 2.

Here, the developing devices 11 provided in the rotary developing device 104 will be further described with reference to FIGS. 3 and 4. In the present embodiment, the developing device 11K for black, the developing device 11Y for yellow, the developing device 11M for magenta and the developing device 11C for cyan are substantially of the same construction except for the colors of the developers. Accordingly, in the following description, when the developing devices for the respective colors need not be particularly distinguished from one another, the suffixes K, Y, M and C given to show that they are elements belonging to the developing devices for the respective colors will be omitted.

The developing device 11 contains therein a two-component developer (developer) chiefly provided with a nonmagnetic toner (toner) and a magnetic carrier (carrier), and in the present embodiment, the density of the toner in the developer in its initial state is of the order of 8% in terms of weight ratio. This value is one which should be properly adjusted in accordance with the charging amount of the toner, the particle diameter of the carrier, the construction of the multi-color image forming apparatus, etc., and is not always restrictive.

The developing device 11 opens at a developing area opposed to the photosensitive drum 101, and a developing sleeve 8 as a developer bearing member is rotatably disposed in such a manner as to be partly exposed in this opening portion. The developing sleeve 8 containing therein a stationary magnet which is magnetic field generating means is formed of a nonmagnetic material, and during the developing operation, it is rotated in the counter-clockwise direction of arrow "b" in FIG. 3, retains thereon the developer in the developing device 11 in the form of a layer and bears and transports it, and supplies the developer to the developing area opposed to the photosensitive drum 101 to thereby develop the electrostatic latent image on the photosensitive drum 101. The developer on the developing sleeve 8 after it has developed the electrostatic latent image is transported in accordance with the rotation of the developing sleeve 8 and is collected into the developing device 11.

The developer in the developing device 11 is circulated in a developing device 11 by a first developer circulating screw 7*a* (a side near to the developing sleeve 8) and a second developer circulating screw 7*b* (a side far from the developing sleeve 8) which are developer agitating and transporting members, and is mixed and agitated. The first developer circulating screw 7*a* and the second developer circulating screw 7*b* are disposed substantially in parallel to the developing sleeve 8, and the direction of circulation of the developer is a direction from this side toward the inner side in FIG. 3 (the direction of arrow "c" in FIG. 4) on the first developer circulating screw 7*a* side, and is a direction from the inner side toward this side in FIG. 3 (the direction of arrow "d" in FIG. 4) on the second developer circulating screw 7*b* side. In the developing device 11, a partition wall 14 is provided so as to partition the space between the first developer circulating screw 7*a* and the second developer circulating screw 7*b* substantially in parallel to the respective developer circulating screws 7*a* and 7*b*. The lengthwise end portions of the partition wall 14 do not reach the inner side wall of the developing device 11, but communicating portions 13*a* and 13*b* are formed there. Through these communicating portions 13*a* and 13*b*, the developer is delivered between the first developer circulating screw 7*a* and the second developer circulating screw 7*b*.

When the developing device 11 performs the developing operation at the developing position P1, the two-component developer (developer) including a toner corresponding to the amount of toner consumed by image forming is supplied from a developer cartridge 6 as a developer supplying container connected to the developing device 11, and at that time, the carrier of the order of 10% in terms of weight ratio is also supplied. That is, each time image forming is terminated, the carrier is supplied to the developing device 11, and particularly when a high-density image is to be formed, a great deal of carrier amounting to the order of several tens of mg is supplied depending on the construction of the apparatus. Therefore, the amount of developer in the developing device 11 is increased and the surface (upper surface) of the developer becomes high. When the surface of the developer becomes higher by an allowable value or greater than the second developer circulating screw 7*b*, the second developer circulating screw 7*b* cannot sufficiently agitate the developer and therefore, the toner immediately after supplied is not sufficiently charged and is transported to the first developer circulating screw 7*a*, and is used for the developing operation. Therefore, toner fog occurs to the white ground portion of the image, and when the amount of developer is further increased, the developer overflows from the developing device 11 and the interior of the apparatus is contaminated.

In the present embodiment, the developing device 11 is provided with a developer supplying port (supplying port) 9 on one end side of the upper wall of the developing device 11 near the second developer circulating screw 7*b*. Also, as will be described later in detail, the developing device 11 is provided with a developer discharging port (discharging port) 1 having a shutter member 3, on the other end side of the upper wall thereof, and this discharging port communicates with one end portion of a developer discharging path (discharging path) 4. The other end of the discharging path 4 communicates with a developer collecting port (collecting port) 2.

When the developing device 11 is disposed at the developing position P1, the discharging port 1 is disposed substantially at the same height as the upper portion of the second developer circulating screw 7*b* and opens upwardly and therefore, it never happens that with an increase in the amount of the two-component developer in the developing device 11, the surface (upper surface) of the developer becomes higher by the allowable value or greater than the second developer circulating screw 7*b*.

Figure 4:
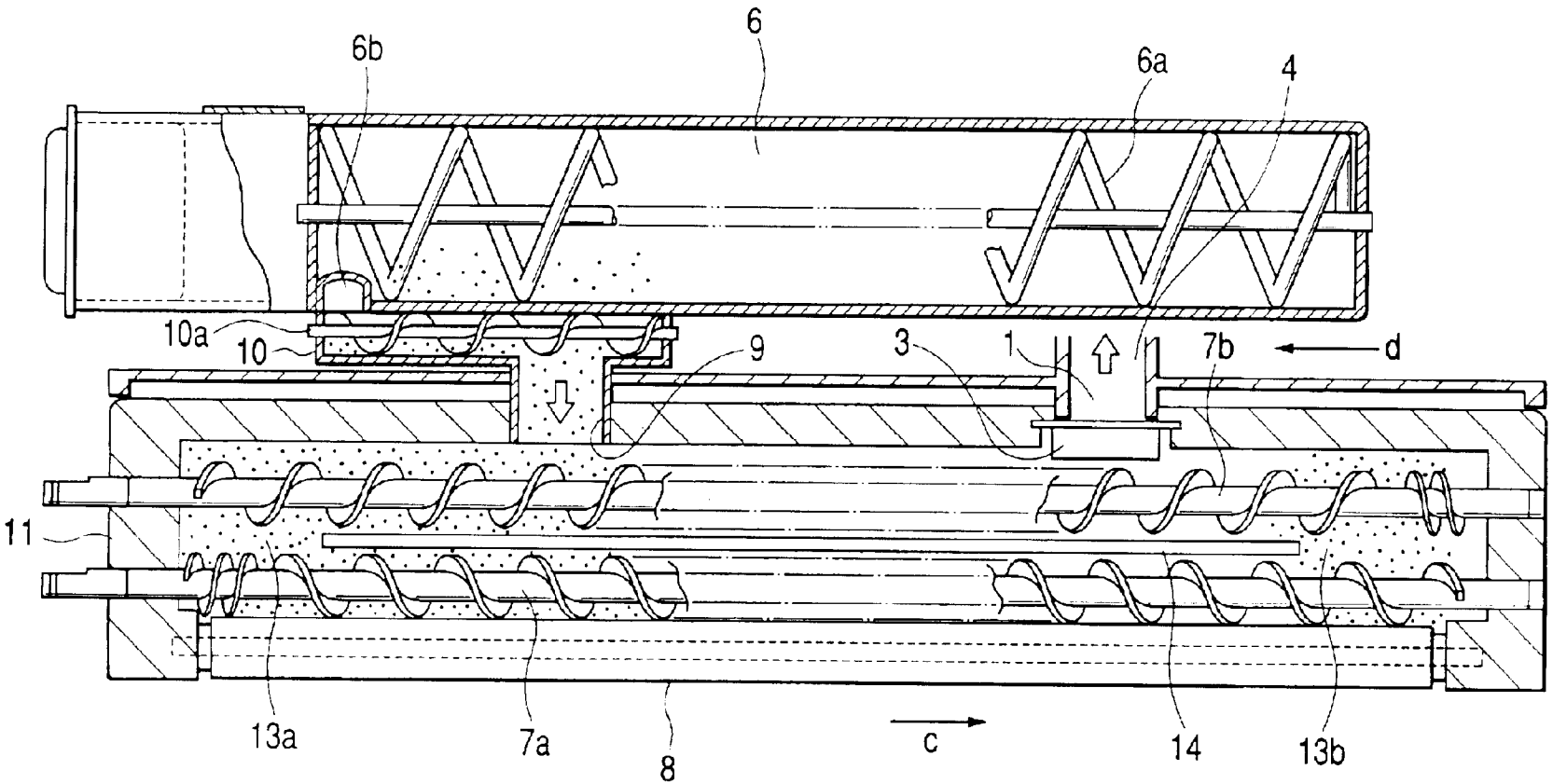
FIG. 4 is a top developed view illustrating the developing device of FIG. 3.
Figure 6:
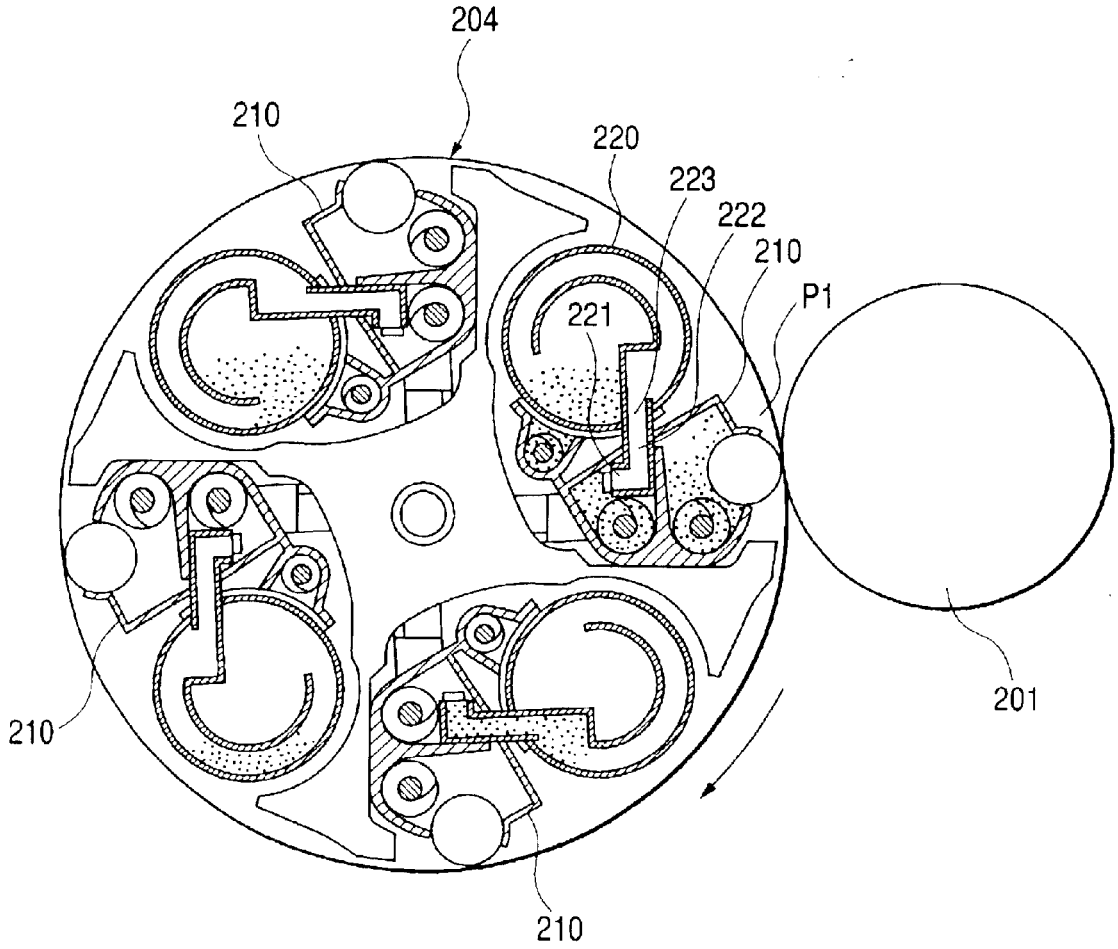
FIG. 6 is a schematic cross-sectional front view of an example of a conventional rotary type developing member.
Figure 7:
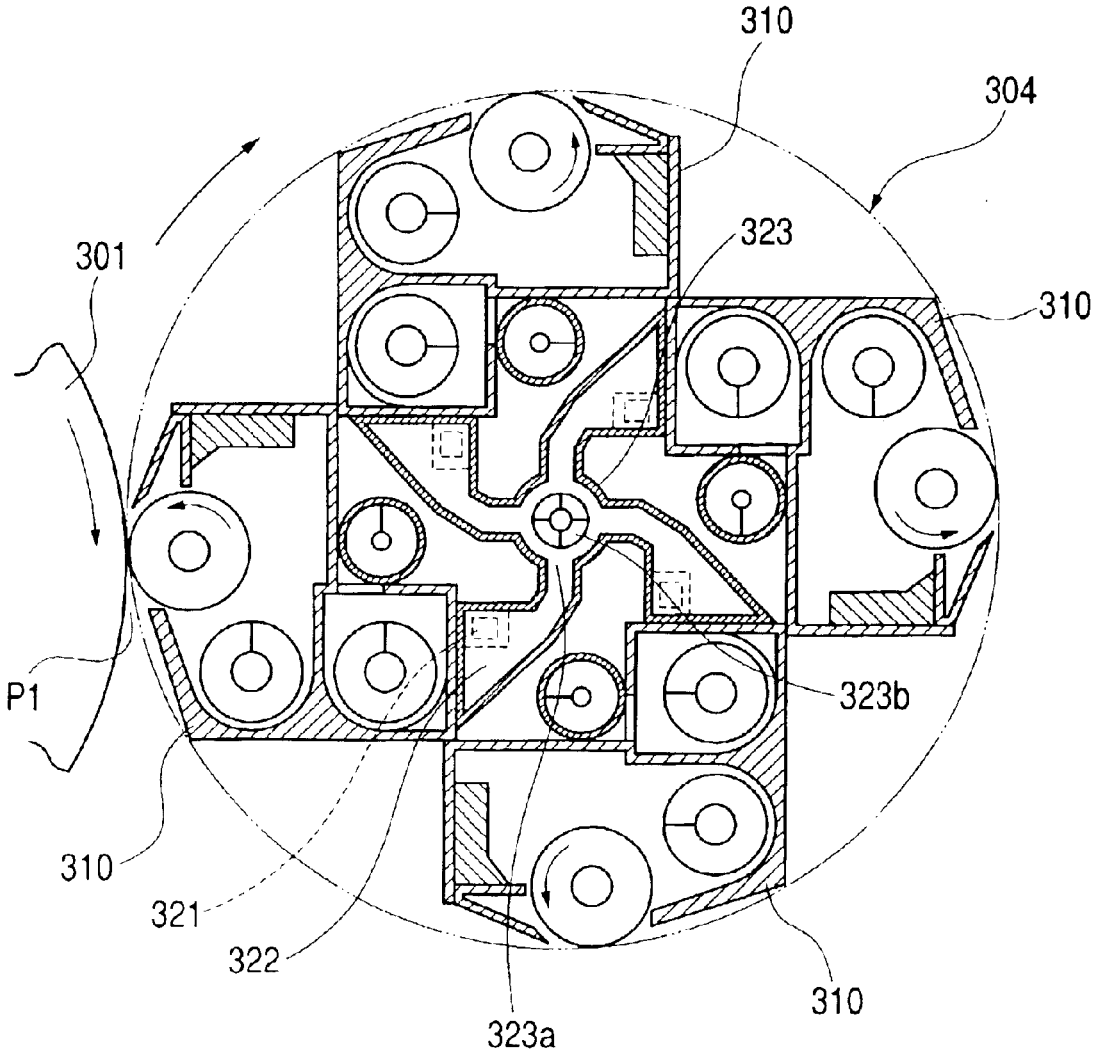
FIG. 7 is a schematic cross-sectional front view of another example of the conventional rotary type developing member.

As shown in FIG. 4, the discharging port 1 is disposed near the second developer circulating screw 7*b* and upstream of the supplying port 9 with respect to the direction of circulation of the developer. Therefore, the circulation of the developer near the developing sleeve 8 is not disturbed, and it never happens that the developer supplied just before is discharged.

The two-component developer containing a toner corresponding to the amount of toner consumed by image forming is supplied into the developing device 11 through the supplying port 9 by the rotational force of a supplying screw 10*a* which is developer supplying means provided in a developer supplying portion 10 and gravity. The developer to be supplied is supplied from a developer cartridge 6 as a developer supplying container to the developer supplying portion 10 through a developer supplying port (supplying port) 6*b*. The supplying screw 10*a* transports the developer supplied from the supplying port 6*b* toward the supplying port 9 in accordance with the rotation thereof, and makes the developer fall into the developing device 11 by gravity.

The developer cartridge 6 is provided with a rotatable developer transporting member 6*a*, and transports the developer therein toward the supplying port 6*b*. The developer cartridge 6 is detachably mounted with respect to the developing device 11 and the rotary developing device 104. By the developer cartridge 6 being mounted with respect to the developing device 11, the supplying port 6*b* is adapted to communicate with the developer supplying portion 10 of the developing device 11. In the present embodiment, the developer cartridge is of a substantially cylindrical shape.

The mixing ratio of the toner and the carrier in this supplied developer is of the order of 9:1 in terms of weight ratio in the present embodiment, but is not particularly restricted to this numerical value. That is, as compared with the ratio between the toner and the carrier in the developer in the developing device 11, the amount of the toner is overwhelmingly great in the developer to be supplied, and considering the volume ratio, it can be considered that a slight amount of carrier is mixed with the toner. That is, when the toner consumed by image forming is to be made up for, a slight amount of carrier is gradually supplied. If the rate of the carrier in the developer to be supplied becomes great, the amount of replacement of the carrier becomes great by the same amount of toner supply and the two-component developer in the developing device 11 approximates to a fresh state, but correspondingly the consumed amount of carrier becomes great, and this leads to an increase in running cost. Therefore, it is preferable to discretely determine a suitable mixing ratio in each apparatus.

The supplied amount of the developer is roughly determined by the number of revolutions of the supplying screw 10*a*, and this number of revolutions is determined by toner supply amount controlling means, not shown. As the toner supply amount controlling means, use can be made of one for calculating an amount of toner corresponding to the amount consumed by image forming as by counting, for example, the number of pixels of a formed image, and converting it into the number of revolutions of the supplying screw 10*a*. Such toner supply amount controlling means itself is well known to those skilled in the art and therefore need not be described any further.

A description will now be made of a method of discharging any excess developer from the developing device 11 which is most characteristic in the present embodiment.

As shown in FIG. 2, the rotary developing device 104 in the present embodiment has the developer discharging port (discharging port) 1 disposed in the developing device 11 for discharging the excess developer, and the developer collecting port (collecting port) 2 disposed in the rotary 104*a* for collecting the excess developer. These are mentioned as the most characteristic portions in the present embodiment.

Also, in the present embodiment, the shutter member 3 for controlling the discharging position of the excess developer is provided near the discharging port 1 provided in the developing device 11, and the developer discharging path (discharging path) 4 which is a communicating portion for communicating the discharging port 1 and the collecting port 2 with each other is also provided.

Provision is further made of a collected developer transporting portion (transporting portion) 5 for transporting the excess developer collected from the collecting port 2 to the outside of the rotary developing device 104. In the present embodiment, the transporting portion 5 is formed in the interior of a cylinder shaft 104*b* which is the rotary shaft of the rotary developing device 104 (hereinafter referred to as the "collected developer transporting pipe (transporting pipe)"). As described above, the transporting portion 5 is formed in the interior of the rotary shaft 104*b* and is thereby provided near the central shaft of rotation of the rotary developing device 104, whereby when the developer is to be collected and transported from the plurality of developing devices 11, the rotary developing device 104 is made maximally compact and the disposition relationship between the developer discharging port 1 and the developer collecting port 2 which will be described later can be optimized. The present invention, however, is not restricted to a construction in which the rotary shaft functions as a collected developer transporting path. In the present embodiment, the collecting port 2 is an opening portion provided in the transporting pipe 5. In the present embodiment, the collecting portion 2 is provided on one end portion side of the transporting pipe 5.

In the interior of the transporting pipe 5, a transporting member (not shown) which is a screw in the present embodiment is rotatably disposed to transport the collected developer, and design is made such that the collected developer can be transported to the outside of the rotary developing device 104 at any timing by drive transmitting means (not shown) provided in the apparatus main body A. The developer transported to the outside of the rotary developing device 104 through the transporting pipe 5 can be collected into a developer collecting container (not shown) or the like connected, for example, to lengthwise one end portion of the transporting pipe 5 and provided in the apparatus main body A.

The discharging path 4 is formed integrally with the rotary developing device 104, and is disposed at a position corresponding to the developing device 11 for each color, and is rotated with the developing device 11 with the rotation of the rotary developing device 104. On the other hand, the transporting pipe 5 is constructed discretely from the rotary developing device 104 (rotary 104*a*) and therefore, the collecting port 2 is an opening at only one location corresponding to the developing position P1. That is, only the discharging path 4 communicating with the developing device 11 disposed at the developing position P1 by the rotation of the rotary developing device 104 is connected to the collecting port 2 provided in the transporting pipe 5.

In the present embodiment, the shutter member has a shutter main body 3*a* which is a sealing portion of larger dimensions than the discharging port 1. The shutter main body 3*a* has its one end portion fixed to a shutter rotary shaft 3*b*, and is rotated about this shutter rotary shaft 3*b* by gravity to thereby open and close the discharging port. The shutter rotary shaft 3*b* is fixed for rotation relative to the inner wall of the developing device 11 near the discharging port 1 by a bearing member (not shown). That is, the shutter member 3, as will be described later in detail, is rotated about the shutter rotary shaft 3*b* to thereby open and close the discharging port 1 from the inside of the developing device 11.

The method of discharging the excessive developer will hereinafter be described in greater detail with reference also to FIGS. 5A, 5B, 5C and 5D, with the developing device 11K for black taken as an example. Such a discharging method also holds true of the developing devices for the other colors, namely, in the present embodiment, the developing device 11Y for yellow, the developing device 11M for magenta and the developing device 11C for cyan.

As shown in FIG. 5A, the discharging port 1K is disposed substantially at the same height as the upper end of the second developer circulating screw 7*b*, and when the developing device 11K for black is at the developing position P1, the shutter member 3K for opening and closing the discharging port 1K, in the present embodiment, is in its opened state by gravity. Accordingly, when the surface of the developer becomes higher than the second developer circulating screw 7*b*, the excessive developer overflows and is discharged from the discharging port 1K, and the surface of the developer in the developing device 11K for black is maintained substantially at the height of the second developer circulating screw 7*b*. Therefore, it never happens that the toner fog to the white ground portion of the image and the overflow of the developer from the developing device 11K for black as noted above occur.

Here, in the present embodiment, the positional relationship between the discharging port 1 and the collecting port 2 when the developing device 11 is at the developing position P1 is characteristic.

That is, in accordance with the present invention, when the developing device 11 is at the developing position P1, the discharging port 1 is located above the collecting port 2. Thus, the developer discharged from the discharging port 1 falls to the collecting port 2 along the discharging path 4 by gravity. Thus, at the developing position P1, the excess developer in the developing device 11 can be continuously discharged out of the developing device 11 at any time and therefore, particularly even in a case where the single-color image forming of high-density images is continued, the rotating operation of the rotary developing device 104 for discharging the developer is not required, and the amount of developer in the developing device 11 can be maintained within an allowable range. Therefore, it never happens that image productivity is lowered.

When the developing operation of the developing device 11K for black is terminated, the rotary developing device 104 is rotated by about 90° in preparation for the developing operation by the developing device 11Y for yellow which is the next color, and the developing device 11K for black which has so far been at the developing position P1 is moved to a position P2 (FIG. 5B). At this time, in the present embodiment, as shown in FIG. 5B, the shutter member 3K is rotatively moved by gravity and the discharging port 1K becomes closed and therefore, it never happens that the developer in the developing device 11K for black leaks out from the discharging port 1K to the discharging path 4K.

This can also be mentioned as a very characteristic point in the present embodiment.

When the developing operation of the developing device 11Y for yellow is terminated, the rotary developing device 104 is again rotated by about 90° in preparation for the developing operation by the developing device 11M for magenta which is the next color, and the developing device 11K for black is moved to a position P3 (FIG. 5C). At this time, as shown in FIG. 5C, the shutter member 3K still closes the discharging port 1K by gravity and therefore, it never happens that the developer in the developing device 11K for black leaks out from the discharging port 1K to the discharging path 4K.

When the developing operation of the developing device 11M for magenta is terminated, the rotary developing device 104 is again rotated by about 90° in preparation for the developing operation by the developing device 11C for cyan which is the next color, and the developing device 11K for black is moved to a position P3 (FIG. 5D). At this time, as shown in FIG. 5D, the shutter member 3K still closes the discharging port 1K by the pressure of the developer in the developing device 11K for black and therefore, it never happens that the developer in the developing device 11K for black leaks out from the discharging port 1K to the discharging path 4K. Even if the developer should leak out, it never happens owing to the action in the direction of gravity that the developer flows to the discharging path 4K.

Owing to such a construction and method, not only at the rotation stop position of 90° each of the developing device 11, but also when the rotary developing device 104 is stopped at other various stop positions such as the home position and the developer cartridge interchanging position as described with respect to the conventional art, the excess developer is always discharged only from the developing device 11 in a stable posture which is at the developing position P1, and is not discharged at any other phase position and therefore, there is realized an always stable discharging characteristic of the excess developer, and this contributes to the stability of a high quality of image.

Also, even when single-color continuous image forming using a developing device 11 is effected, it becomes possible to continue to collect the developer including the deteriorated carrier into the collecting port 2 by the utilization of the direction of gravity without rotatively moving the developing device 11 from the developing position P1, and excellent image quality maintaining stability can be realized without image productivity being lowered.

Further, there is not required such a complicated constituent member as a storing chamber for storing therein the excess developer discharged at the developing position P1 until the rotation of the rotary developing device 104 is effected, and this means an inexpensive and stable construction. The work of interchanging the developer also becomes unnecessary and therefore, an improvement in maintenance property and a decrease in running cost can be realized.

Further describing, according to my studies, the deterioration of the developer due to its long-term use originates from two great causes, i.e., so-called toner-spent in which the toner is secured to the surface of the carrier, and so-called extraneous additive adherence in which an extraneous additive having drifted away from the toner adheres to the surface of the carrier. When the toner-spent and extraneous additive adherence to the surface of the carrier occur, a carrier surface area capable of charging the toner decreases and therefore, the charging amount of the toner is lowered. Therefore, there occur image defects such as an increase in image density and toner fog to a white portion, and the contamination of the image forming apparatus by the scattering of the toner.

According to the present embodiment, however, the developer including the deteriorated carrier is discharged out of the developing device 11 and is gradually replaced with a developer including a fresh carrier, whereby it becomes possible to stop the apparent progress of the deterioration of the carrier and stabilize the characteristic as the whole of the developer, and the stability of a high quality of image heightens.

On the other hand, in a rotation developing process as well, it is often the case that single-color continuous image forming is required. According to the present embodiment, at the developing position P1 whereat the developing device 11 becomes proximate to the photosensitive drum 101, the excessive developer in the developing device 11 is contained from the discharging port 1 into the collecting port 2 by gravity. Therefore, even during the single-color continuous image forming, it is possible to maintain the amount of developer in the developing device 11 within an allowable value without stopping the developing operation and therefore, the operation of rotating the rotary developing device 104 to discharge the developer in the developing device 11 becomes unnecessary, and image productivity is not lowered. In addition, use is not made of such a member and an apparatus unnecessary for ordinary image forming as a mechanism member for once storing the excessive developer therein and therefore, the complication and higher cost of the apparatus are not caused, and such an improvement in maintenance property as the interchange of the developer during service maintenance becoming unnecessary can be realized.

Also, according to the present embodiment, the discharging and collecting of the excessive developer can be done only at the developing position P1, and at the other phase positions of the developing device 11, the shutter member 3 can suppress the discharging of the excessive developer. Thus, even in the case that the rotary developing device 104 has a plurality of rotation stop positions as in a construction wherein the developing sleeve 8 is stopped and waits at a home position whereat it is not opposed to the photosensitive drum 101 or a construction in which it is stopped and waits at a developer cartridge interchanging position, as has heretofore often been seen in an image forming apparatus having a rotary type developing member, the discharging and collecting of the developer can be done only at the developing position P1, and at the other phase positions of the developing device, the shutter member 3 can suppress the discharging of the developer. Consequently, even if the rotation stop positions are further increased, it never happens that the discharging mechanism becomes unstable and it becomes difficult to maintain a high quality of image. Accordingly, even in the case that the developing device exhibits, besides a development stop position visiting periodically and stably during a continuous image forming operation, such unstable stop position behavior as a home position waiting position visiting after the termination of a job, or a developer cartridge interchange stop waiting position at which the developing device is stopped and waits only when the toner in the developer cartridge 6 has become little, a stable developer discharging characteristic can be obtained and no trouble is required in the setting of a condition therefor.

As described above, according to the present embodiment, the high maintenance property that the interchange of the developer is unnecessary, and the high image productivity particularly when single-color image forming is continued can be realized by a simple construction.

It should be understood that the construction of the multi-color image forming apparatus described in the present embodiment is exemplification for describing the present invention, and the present invention is not restricted thereto, but various changes are possible within the scope of the present invention. For example, while in the above-described embodiment, the image forming apparatus adopts an intermediate transferring process, the present invention restricts the transferring process in no way, but may adopt the process of successively superimposing and transferring toner images on a recording material borne on a transfer material bearing member which is well known to those skilled in the art, or like process.

As described above, according to the above-described Embodiment 1, the high maintenance property that the interchange of the developer is unnecessary and high image productivity can be realized by a simple construction. Also, even in a case where a rotary type developing member having a plurality of developing devices is stopped at a plurality of phase positions, it becomes possible to maintain images of high quality always stably.

Embodiment 2

Figure 8:
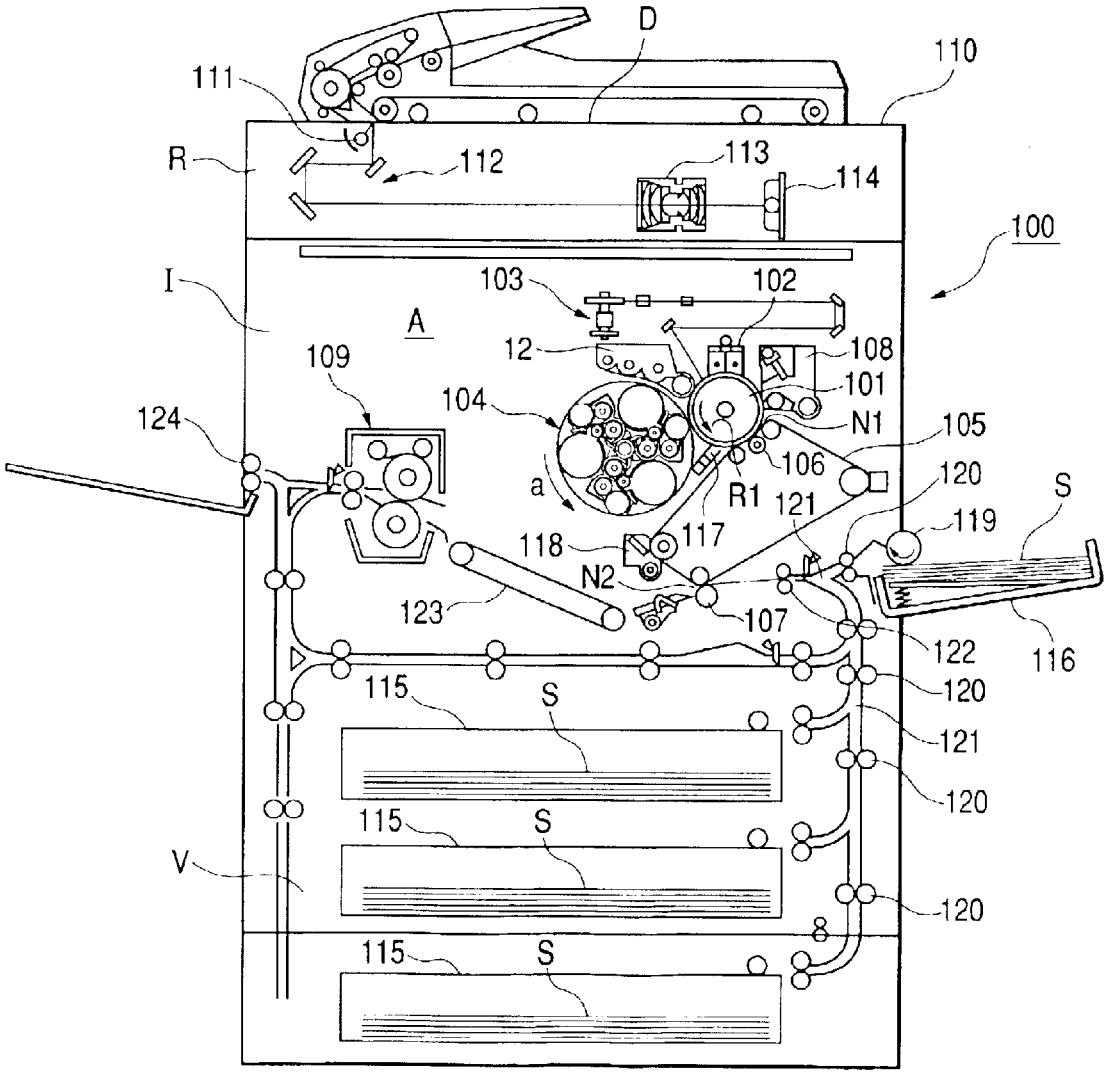
FIG. 8 is a schematic cross-sectional front view of an image forming apparatus according to Embodiment 2.

FIG. 8 is a schematic cross-sectional view of an image forming apparatus according to Embodiment 2. The image forming apparatus of the present embodiment is the same as that of the above-described embodiment except for some constructions, and the same members as those in the above-described embodiment are given the same reference characters, but a detailed description thereof will hereinafter be made again.

The image forming apparatus 100 of the present embodiment has a rotary developing device 104 which is a rotary type developing member most characteristic in the present embodiment. Also, an image forming apparatus main body (apparatus main body) A is provided with a reader portion R provided with an original supporting stand 110, a light source 111, a mirror system 112, a lens system 113 and a CCD unit 114, a paper feeding portion V, an image forming portion I, etc. The paper feeding portion V has cassettes 115 and a manually feeding cassette 116 containing transfer materials S such as recording paper or OHP sheets therein and detachably mountable with respect to the apparatus main body A, and the transfer materials S are supplied from these cassettes 115 and the manually feeding cassette 116.

In the image forming portion I, there are disposed a cylindrical electrophotographic photosensitive member, i.e., a photosensitive drum 101, as an image bearing member, a primary charging device 102 as charging means for charging the photosensitive drum 101, a singly constructed developing device (developing means) 12 for black, a rotary developing device 104 (FIG. 9) containing therein color developing devices (developing means) 11 for other three colors on which developer cartridges 6 are integrally mounted, a post-charging device 117 for adjusting the quality of an image after being developed, an endless ring-shaped transfer belt 105 which is an intermediate transfer member for superimposing, for example, toner images of four colors and transfer-forming a multi-color image thereon, and thereafter transferring the multi-color image to the transfer material S, a drum cleaner 108 for removing any toners (untransferred toners), etc. residual on the photosensitive drum 101 after the transfer, a secondary transfer roller 107 as secondary transferring means for transferring the toner image from the transfer belt 105 to the transfer material S at a secondary transferring portion N2, a belt cleaner 118 for removing any untransferred toners on the transfer belt 105, etc. The transfer belt 105 is passed over a plurality of rollers and is endlessly moved. At a position opposed to the photosensitive drum 101 with the transfer belt 105 interposed therebetween, there is disposed a primary transfer roller 106 which is primary transferring means for transferring the toner images from the photosensitive drum 101 to the transfer belt 105, whereby a primary transferring portion N1 is formed.

As shown in FIG. 8, in the present embodiment, the developing device 12 for black and the rotary developing device 104 are disposed in the image forming portion I, and this rotary developing device 104 has the color developing devices for three colors, i.e., the developing device 11Y for yellow, the developing device 11M for magenta and the developing device 11C for cyan. In the present embodiment, the construction of a three-color rotary is shown as an example of the rotary developing device 104, but from the gist of the present invention, of course, the number of the developing devices carried on the rotary is not restricted thereto.

In the transport route of the transfer material S, on the upstream side of the image forming portion I, there are provided registration rollers 122 for enhancing the posture position accuracy of the transfer material S supplied from the cassette 115 or the manually feeding cassette 116 in the paper feeding portion V through the intermediary of a pickup roller 119, transport rollers 120 and a transport path 121, and feeding out the transfer material S in timed relationship with the toner images on the transfer belt 105. Also, on the downstream side of the image forming portion I, there are disposed a transporting apparatus 123 for transporting the transfer material S to which the toner images have been transferred, a fixing apparatus 109 for fixing an unfixed image on the transfer material S, delivery rollers 124 for delivering the transfer material S on which the image has been fixed to the outside of the apparatus main body A.

A description will now be made of the operation of the image forming apparatus 100 of the present embodiment. When a paper feeding signal is outputted from a control apparatus (not shown) provided in the apparatus main body A for generally controlling the operation of the image forming apparatus 100, a transfer material S is supplied from the cassette 115 or the manually feeding cassette 116. On the other hand, light applied from the light source 111 in the reader portion R to an original D placed on the original supporting stand 110 and reflected by the original D is once read by the CCD unit 114, and thereafter is converted into an electrical signal. This signal is replaced with a laser beam L from a laser scanner unit 103 as exposure means provided in the image forming portion I, and the laser beam L is applied onto the photosensitive drum 101 rotated in the counter-clockwise direction of arrow R1 in FIG. 8. The photosensitive drum 101 is charged in advance by the primary charging device 102, and by the light being applied thereto, an electrostatic latent image is formed thereon. Then, for example, a black toner image is first formed by the developing device 11K for black.

The black toner image formed on the photosensitive drum 101 has its potential adjusted by the post-charging device 117, and is soon transferred onto the transfer belt 105 by the action of a primary transferring bias voltage applied to the primary transfer roller 106 at the primary transferring portion N1. In the case of the color mode, the toner image transferred to the transfer belt 105 goes toward the primary transferring portion N1 by the transfer belt 105 being caused to make one more rotation so that the next toner image may be formed and transferred. In the meantime, the rotary developing device 104 rotates the developing device 11 for the next designated color of the color developing-devices contained therein in the counter-clockwise direction of arrow "a" in FIG. 9 so as to be opposed to the photosensitive drum 101 in order to begin to be prepared for forming the first toner image, and is prepared to develop the next electrostatic latent image.

Thus, in a full-color mode, the steps of forming and developing the electrostatic latent image, and transferring the developed image are repeated until a predetermined image (color) number of toner images have been successively transferred to the transfer belt 105.

On the other hand, the transfer material S fed from the paper feeding portion V has its skew feed corrected by the registration rollers 122, and is further adjusted in timing and is sent to the image forming portion I. Then, by the action of a secondary transferring bias voltage applied to the secondary transfer roller 107, the toner images are transferred from the transfer belt 105 to the transfer material S.

Thereafter, the transfer material S separated from the transfer belt 105 is transported to the fixing apparatus 109 by the transporting apparatus 123, and the unfixed transferred image is permanently fixed on the transfer material S by heat and pressure. The transfer material S on which the image has been fixed is delivered out of the apparatus main body A by the delivery rollers 124.

In this manner, an image is formed on the transfer material S fed from the paper feeding portion V and the transfer material S is delivered. Also, any untransferred toners, etc. residual on the photosensitive drum 101 after the toner images have been transferred are removed by the drum cleaner 108, and any untransferred toners, etc. residual on the transfer belt 105 are removed by the belt cleaner 118, and the photosensitive drum 101 and the transfer belt 105 are repetitively used for image forming.

The rotary developing device (rotary type developing member) 104 in the present embodiment will now be further described.

In the present embodiment, the rotary developing device 104 has the developing device 11Y for yellow, the developing device 11M for magenta and the developing device 11C for cyan in a rotary 104*a* which is a rotatable developing device supporting member, and the rotary developing device 104 is freely rotatable about a rotary shaft (cylinder shaft) 104*b* by a motor (not shown) as driving means provided in the apparatus main body A.

As will be described later in detail, the rotary developing device 104 is stopped at a rotated position 60° short of a developing position P1 at which the photosensitive drum 101 and the developing device 11Y for yellow are in proximity to each other as an initial state (FIGS. 14A, 14B and 14C). This is for causing a developing sleeve 8 provided in the developing device 11 for each color to be stopped and wait at a phase position farthest from the photosensitive drum 101 so that the photosensitive drum 101 may not be adversely affected by the strong magnetic force of the developing sleeve 8 as a developer bearing member.

Figure 9:
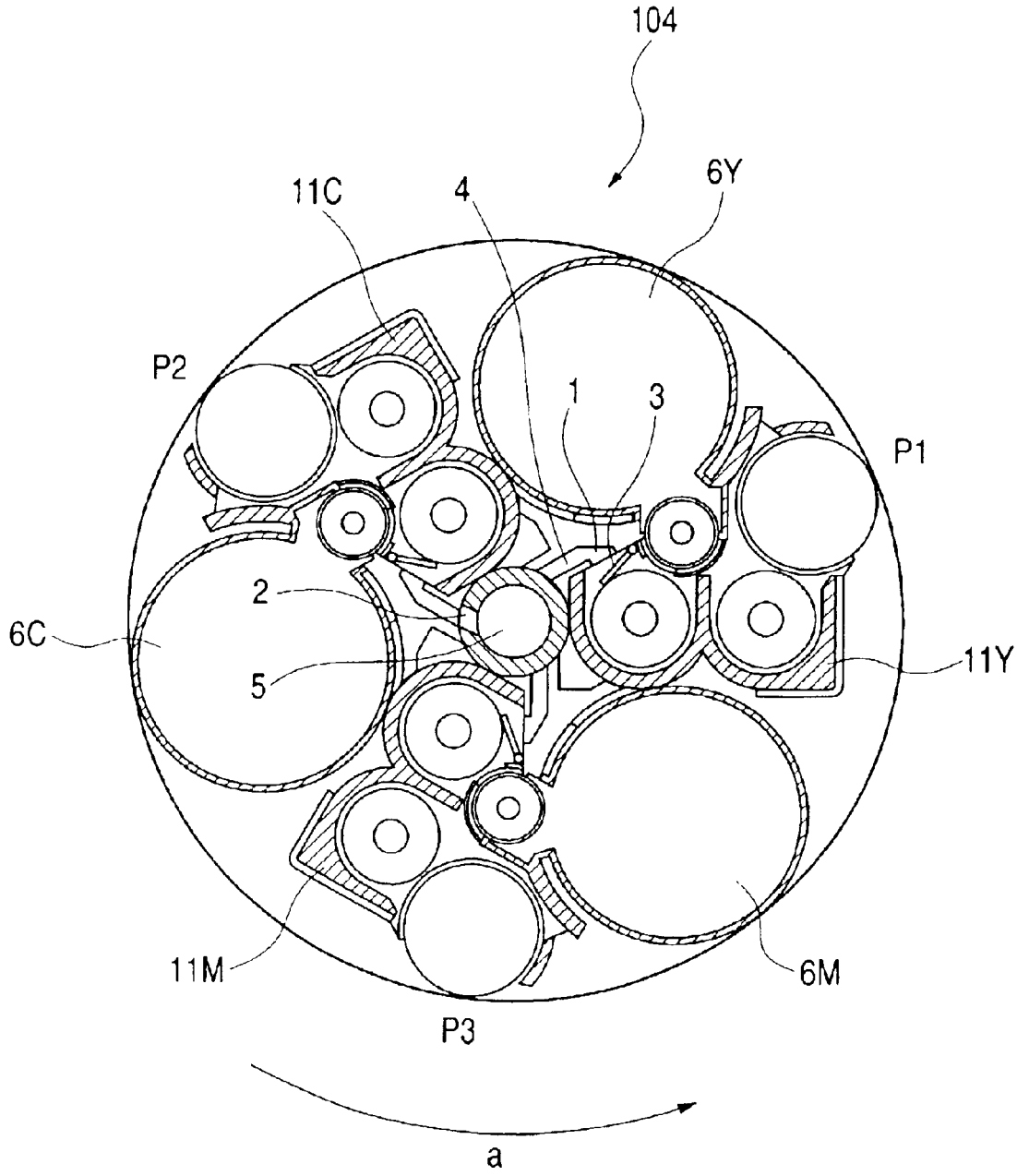
FIG. 9 is a schematic cross-sectional front view of a rotary developing device provided in the image forming apparatus.

When for example, a full-color toner image is to be formed on the photosensitive drum 101, the rotary developing device 104 is first rotatively moved by 60° in the counter-clockwise direction of arrow "a" in FIG. 9 after the termination of the developing by the developing device 12 for black to thereby dispose the developing device 11Y for yellow at the developing position P1 whereat it is proximate to the photosensitive drum 101, and effect developing. Next, in order to form a toner image of other color, the rotary developing device 104 is rotated by 120° to thereby dispose the developing device 11M for magenta at the developing position P1, and likewise effect developing. Further, in order to form a cyan toner image, the rotary developing device 104 is further rotated by 120° to thereby effect developing in the same manner as described above. When the developing operations in the respective colors are terminated, the rotary developing device 104 is rotated by 60° to wait again at the home position, and comes to wait for the start of the next job.

When the forming of a black image (black-and-white image) is to be effected, a toner image formed on the photosensitive drum 101 by the developing device 12 for black containing a black toner therein is primary-transferred onto the transfer belt 105, and thereafter is immediately secondary-transferred onto the recording paper S. Thereafter, the recording paper S stripped off from the transfer belt 105 is transported by the transporting apparatus 123, and is pressurized heated by the fixing apparatus 109, whereby a permanent image is formed on the surface thereof. The single-color image forming by this process is higher in image productivity by the order of four times than full-color image forming.

Figure 10:
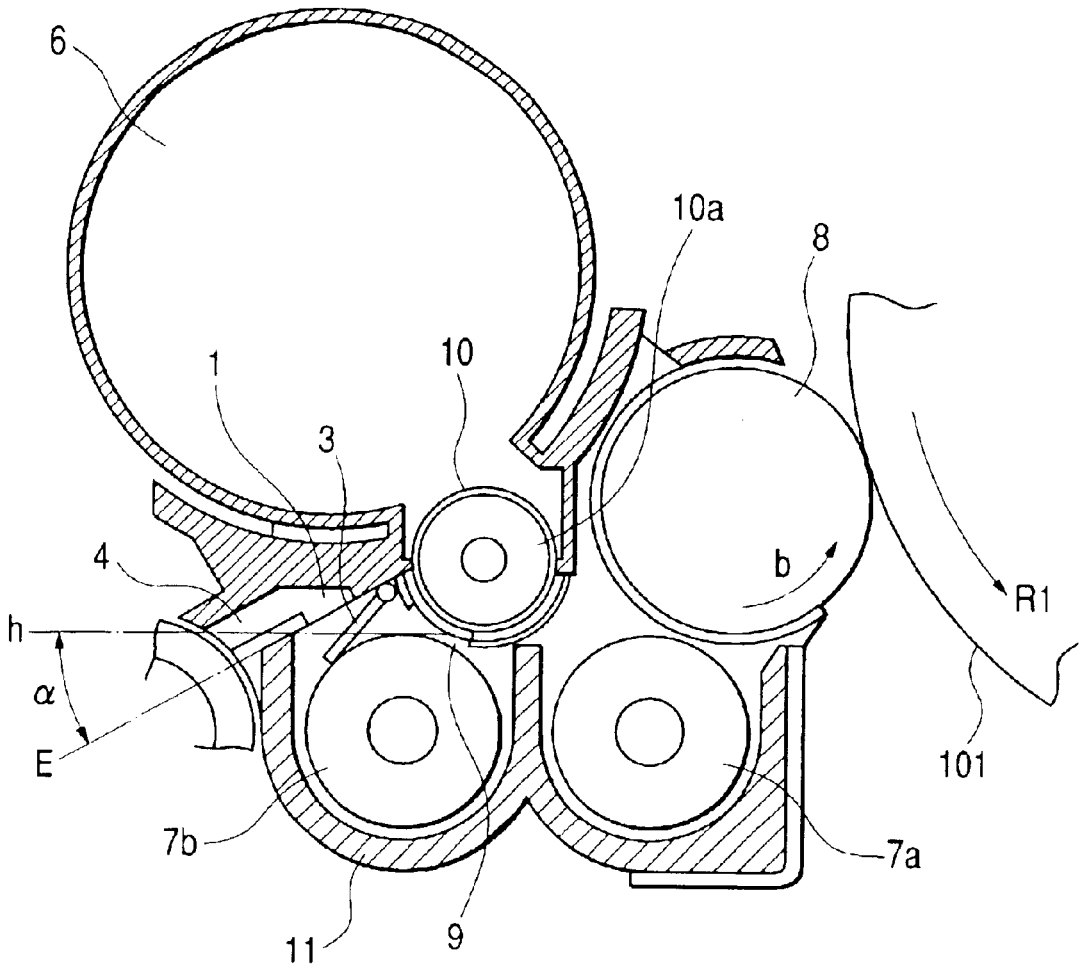
FIG. 10 is a schematic cross-sectional front view of a developing device provided in the rotary developing device of FIG. 9.
Figure 11:
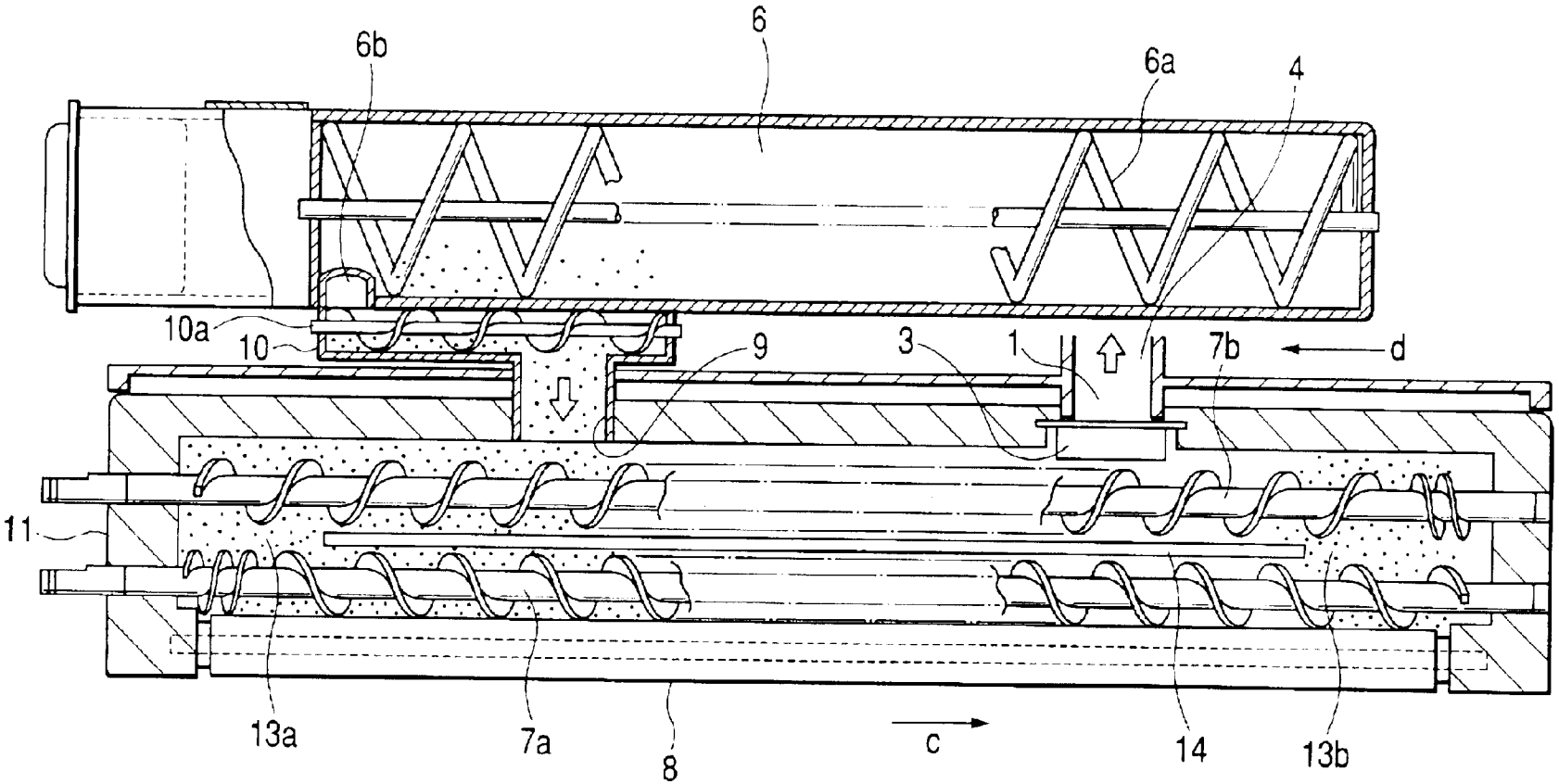
FIG. 11 is a top developed view illustrating the developing device of FIG. 10.

The construction of the color developing devices carried in the rotary developing device 104 will be further described here with reference also to FIGS. 10 and 11. In the present embodiment, the color developing devices 11, i.e., the developing device 11Y for yellow, the developing device 11M for magenta and the developing device 11C for cyan are substantially of the same construction except for the colors of the developers. Accordingly, in the following description, when it is unnecessary to particularly distinguish the developing devices for the respective colors from one another, the suffixes Y, M and C given to show that they are elements belonging to the developing devices for the respective colors are omitted.

The developing device 11 contains therein a two-component developer (developer) chiefly provided with a nonmagnetic toner (toner) and a magnetic carrier (carrier), and in the present embodiment, the density of the toner in the developer in its initial state is of the order of 8% in terms of weight ratio. This value should be properly adjusted depending on the charging amount of the toner, the particle diameter of the carrier, the construction of the multi-color image forming apparatus etc., and is not always restrictive.

The developing device 11 opens in a developing area opposed to the photosensitive drum 101, and the developing sleeve 8 as a developer bearing member is rotatably disposed in such a manner as to be partly exposed in this opening portion. The developing sleeve 8 containing therein a stationary magnet which is magnetic field generating means is formed of a nonmagnetic material, and during the developing operation, it is rotated in the counter-clockwise direction of arrow "b" in FIG. 10, and retains thereon the two-component developer in the developing device 11 in a layer shape and bears and transports the developer thereon to thereby supply the developer to the developing area opposed to the photosensitive drum 101 and develop an electrostatic latent image on the photosensitive drum 101. The developer on the developing sleeve 8 after the electrostatic latent image has been developed is transported in accordance with the rotation of the developing sleeve 8, and is collected into the developing device 11.

The developer in the developing device 11 is circulated in the developing device 11 by a first developer circulating screw 7*a* (a side near to the developing sleeve 8) and a second developer circulating screw 7*b* (a side far from the developing sleeve 8) which are developer agitating and transporting members, and is mixed and agitated. The first developer circulating screw 7*a* and the second developer circulating screw 7*b* are disposed substantially in parallel to the developing sleeve 8, and the direction of circulation of the developer is a direction from this side toward the inner side of FIG. 10 (the direction of arrow "c" in FIG. 11) on the first developer circulating screw 7*a* side, and is a direction from the inner side toward this side of FIG. 10 (the direction of arrow "d" in FIG. 11) on the second developer circulating screw 7*b* side. In the developing device 11, a partition wall 14 is provided so as to partition the space between the first developer circulating screw 7*a* and the second developer circulating screw 7*b* substantially in parallel to the developer circulating screws 7*a* and 7*b*. The lengthwise end portions of the partition wall 14 do not reach the inner side wall of the developing device 11, and communicating portions 13*a* and 13*b* are formed there. Through these communicating portions 13*a* and 13*b*, the developer is delivered between the first developer circulating screw 7*a* and the second developer circulating screw 7*b*.

When the developing device 11 performs a developing operation at the developing position P1, a two-component developer (developer) including a toner corresponding to an amount of toner consumed by image forming is supplied from a developer cartridge 6 as a developer supplying container connected to the developing device 11, and at that time, a carrier of the order of 10% in terms of weight ratio is also supplied. That is, each time image forming is terminated, the carrier is supplied to the developing device 11, and particularly when a high-density image is to be formed, a great deal of carrier amounting to the order of several tens of mg is supplied depending on the construction of the apparatus. Therefore, the amount of developer in the developing device 11 is increased and the surface (upper surface) of the developer becomes high. When the surface of the developer becomes higher by an allowable value or greater than the second developer circulating screw 7*b*, the second developer circulating screw 7*b* cannot sufficiently agitate the developer and therefore, the toner immediately after supplied is transported to the first developer circulating screw 7*a* while remaining not sufficiently charged, and is used for the developing operation. Therefore, toner fog occurs to the white ground portion of an image, and when the amount of developer is further increased, the developer overflows from the developing device 11, and the interior of the apparatus is contaminated.

In the present embodiment, the developing device 11 is provided with a developer supplying port (supplying port) 9 on one end side of the upper wall of the developing device 11 which is near the second developer circulating screw 7*b*. Also, as will be described later in detail, a developer discharging port (discharging port) 1 having a shutter member 3 is provided on the other end side of the upper wall, and communicated with one end portion of a developer discharging path (discharging path) 4. Also, as will be described later, in the present embodiment, at a predetermined rotation stop position of the rotary developing device 104, the other end of the discharging path 4 communicates with a developer collecting port (collecting port) 2.

When the developing device 11 is disposed at the developing position P1, the discharging port 1 is disposed substantially at the same height as the upper portion of the second developer circulating screw 7*b* and opens upwardly and therefore, it never happens that with an increase in the amount of the two-component developer in the developing device 11, the surface (upper surface) of the developer becomes higher by the allowable value or greater than the second developer circulating screw 7*b*.

The discharging port 1 is disposed near the second developer circulating screw 7*b* and upstream of the supplying port 9 with respect to the direction of circulation of the developer. Therefore, the circulation of the developer near the developing sleeve 8 is not disturbed, and it never happens that the developer supplied just before is discharged.

The two-component developer containing a toner corresponding to an amount of toner consumed by image forming is supplied into the developing device 11 through the supplying port 9 by the rotational force of a supplying screw 10*a* which is developer supplying means provided in a developer supplying portion 10 and gravity. The developer to be supplied is supplied to the developer supplying portion 10 from a developer cartridge 6 as a developer supplying container through a developer supplying port (supplying port) 6*b*. The supplying screw 10*a* transports the developer supplied through the supplying port 6*b* toward the supplying port 9 in accordance with the rotation thereof, and makes the developer fall to the developing device 11 by gravity.

The developer cartridge 6 is provided with a rotatable developer transporting member 6*a*, and transports the developer therein toward the supplying port 6*b*. The developer cartridge 6 is detachably mounted with respect to the developing device 11 and the rotary developing device 104. By the developer cartridge 6 being mounted with respect to the developing device 11, the supplying port 6*b* is adapted to communicate with the developer supplying portion 10 of the developing device 11. In the present embodiment, the developer cartridge 6 is of a substantially cylindrical shape.

The mixing ratio of the toner and the carrier in this supplied developer is of the order of 9:1 in terms of weight ratio in the present embodiment, but is not particularly restricted to this numerical value. That is, as compared with the ratio between the toner and the carrier in the developer in the developing device 11, the amount of toner is overwhelmingly great in the developer to be supplied, and considering a volume ratio, it can also be considered that a slight amount of carrier is mixed with the toner. That is, when the toner consumed by image forming is to be made up for, a slight amount of carrier is gradually supplied. If the rate of the carrier in the developer to be supplied becomes great, the amount of replacement of the carrier becomes great by the supply of the same amount of toner and the two-component developer in the developing device 11 approximates to a fresh state, but correspondingly the amount of consumed carrier becomes great, and this leads to an increase in running cost. Therefore, it is preferable to discretely determine a suitable mixing ratio in each apparatus.

The supply amount of the developer is roughly determined by the number of revolutions of the supplying screw 10*a*, and this number of revolutions in turn is determined by toner supply amount controlling means, not shown. As the toner supply amount controlling means, use can be made of one for calculating an amount of toner corresponding to an amount of toner consumed by image forming as by counting, for example, the number of pixels of a formed image, and converting it into the number of revolutions of the supplying screw 10*a*, or the like. Such toner supply amount controlling means itself is well known to those skilled in the art and therefore need not be described any further.

As regards also the developing device 12 for black, the construction of the developing device itself can be made similar to that of the color developing device 11. The developer is supplied from a discretely provided developer supplying container (not shown) to the developing device 12 for black.

Figure 12:
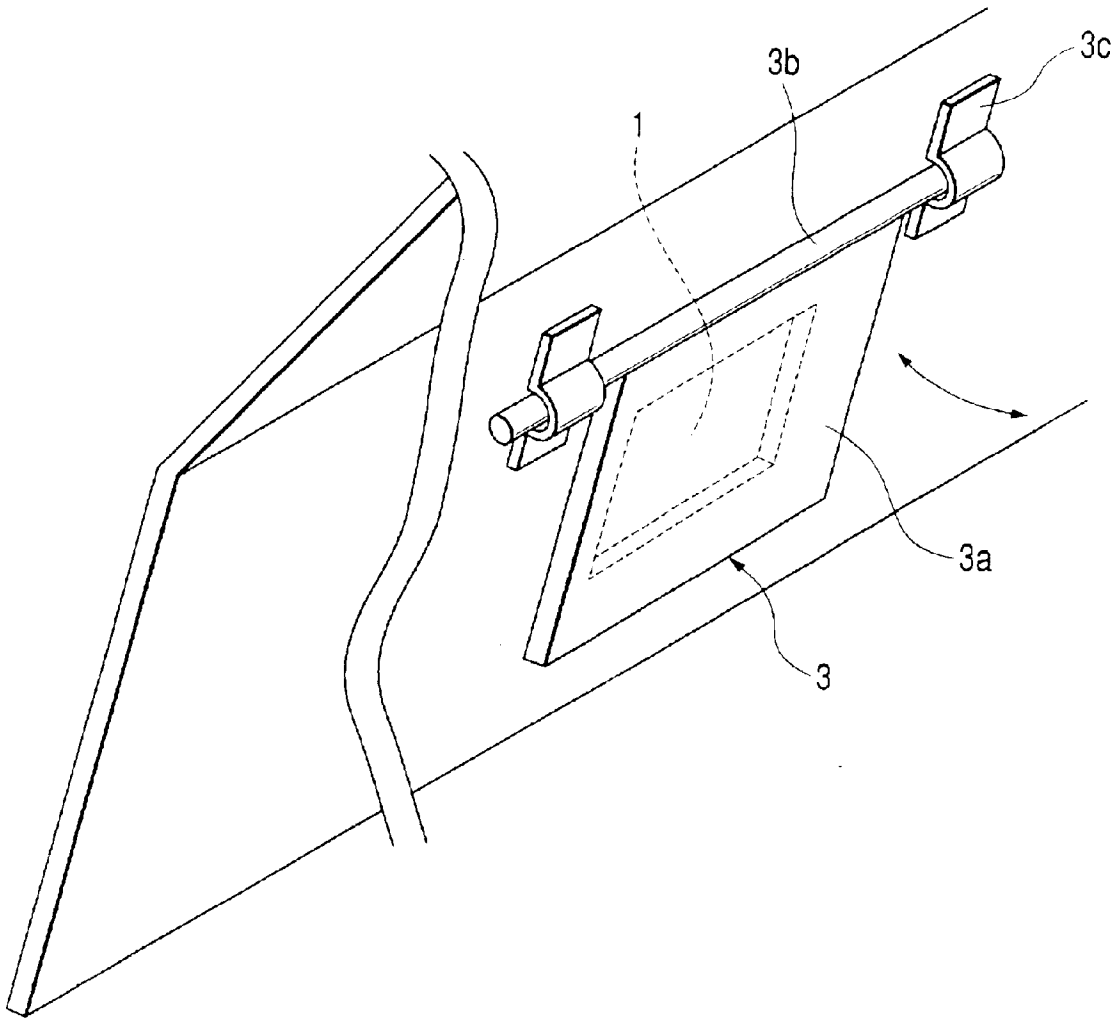
FIG. 12 is a schematic perspective view illustrating the discharge port and shutter member of the developing device of FIG. 10.

Reference is now had also to FIG. 12 to describe a method of discharging any excessive two-component developer (excessive developer from the color developing device 11 which is characteristic in the present embodiment. Such a discharging method is similar with respect to the respective color developing devices 11, i.e., the developing device 11Y for yellow, the developing device 11M for magenta and the developing device 11C for cyan.

As shown in FIG. 9, the rotary developing device 104 in the present embodiment has a developer discharging port (discharging port) 1 disposed in the developing device 11 for discharging the excess developer therethrough, and a developer collecting port (collecting port) 2 disposed in the rotary 104*a* for collecting the excess developer therethrough.

Also, in the present embodiment, a shutter member 3 for controlling the discharging position of the excessive developer is disposed near the discharging port 1 provided in the developing device 11. The shutter member 3, as shown in FIG. 12, has a shutter main body 3*a* which is a sealing portion larger in dimensions than the discharging port 1. The shutter main body 3*a* has its one end portion fixed to a shutter pivot shaft 3*b*, and is pivotally moved about this shutter pivot shaft 3*b* by gravity to thereby open and close the discharging port 1. The shutter pivot shaft 3*b* is pivotally fixed to the inner wall of the developing device 11 near the discharging port 1 by bearing members 3*c*. That is, the shutter member 3, as will be described later in detail, is pivotally moved about the shutter pivot shaft 3*b* to thereby open and close the discharging port 1 from the inside of the developing device 11.

Here, that surface (discharging port surface) E of the discharging port 1 which is adjacent to the developing device 11 when the shutter member 3 renders the discharging port 1 closed is set so as to be inclined by an angle ($\alpha$) of 30° from a horizontal plane "h" at the developing position P1 (FIG. 10). This is mentioned as the most characteristic portion in the present embodiment.

From the gist of the present invention, however, this angle $\alpha$ is not restricted to 30°, but may of course be other angle. This angle $\alpha$, as will be described later in detail, can be set to the most preferable angle for rendering the discharging port 1 opened when the discharging port 1 is at a higher level than the surface of the developer in the developing device 11, and rendering the discharging port 1 closed when the discharging port 1 is at a lower level than the surface of the developer.

The discharging port 1 of the developing device 11 is disposed substantially at the same height as the upper end of the second developer circulating screw 7*b*, and when the developing device 11 is at the developing position P1, in the present embodiment, the shutter member 3 for opening and closing the discharging port 1 is rendered opened by gravity. Accordingly, when the surface of the developer becomes higher than the second developer circulating screw 7*b*, the excessive developer overflows and is discharged from the discharging port 1Y, and the surface of the developer in the developing device 11Y for yellow is maintained substantially at the height of the second developer circulating screw 7*b*. Therefore, it never happens that the toner fog onto the white ground portion of the image and the overflow of the developer from the developing device 11Y for yellow as noted above occur.

Also, there is provided a developer discharging path (discharging path) 4 which is a communicating portion for communicating the discharging port 1 and the collecting port 2 with each other. The developer discharged through the discharging port 1 goes down along the discharging path 4 by gravity. The discharging path 4 once stores therein the excess two-component developer discharged from the developing device 11, and thereafter discharges the developer into the collecting port 2.

There is further provided a collected developer transporting portion (transporting portion) 5 for transporting the excess developer collected through the collecting port 2 to the outside of the rotary developing device 104. In the present embodiment, the transporting portion 5 is formed in the interior of a cylinder shaft 104*b* which is the rotary shaft of the rotary developing device 104 (the transporting portion 5 will hereinafter be referred to as the "collected developer transporting pipe (transporting pipe)"). As described above, the transporting portion 5 is formed in the interior of the rotary shaft 104*b* and is thereby provided near the center axis of rotation of the rotary developing device 104, whereby when the developers are to be collected and transported from the plurality of developing devices 11, the rotary developing device 104 can be made maximally compact, and the disposition relationship between the developer discharging port 1 and the developer collecting port 2 which will be described later can be optimized. The present invention, however, is not restricted to a construction in which the rotary shaft functions as the collected developer transporting path. In the present embodiment, the collecting port 2 is an opening portion provided in the transporting pipe 5. In the present embodiment, the collecting portion 2 is provided on one end portion side of the transporting pipe 5.

In the present embodiment, in the interior of the transporting pipe 5, there is rotatably disposed a transporting member (not shown) which, in the present embodiment, is a screw in order to transport the collected developer so that the collected developer can be transported to the outside of the rotary developing device 104 at any timing by drive transmitting means (not shown) provided in the apparatus main body A. The developer transported to the outside of the rotary developing device 104 through the transporting pipe 5 can be collected, for example, into a developer collecting container (not shown) connected to a lengthwise end portion of the transporting pipe 5 and provided in the apparatus main body A, or the like.

In the present embodiment, a system in which there is disposed a storing portion (in the present embodiment, provided by the discharging path 4) for once storing therein the once discharged excess developer will be described as an example. That is, in the present embodiment, the discharging path 4 is formed integrally with the rotary developing device 104, and is disposed at a location corresponding to the developing device 11 for each color, and is rotated with the developing device 11 with the rotation of the rotary developing device 104. On the other hand, the transporting pipe 5 is constructed discretely from the rotary developing device 104, i.e., the rotary 104*a* which is a developing device supporting member corresponding to the main body thereof, and therefore the collecting port 2 is an opening only at one location corresponding to a position P2, i.e., a position at which the developing device 11 being at the developing position P1 has been moved by 120° in the direction of rotation of the rotary developing device 104 and stopped. That is, only the discharging path 4 communicating with the developing device 11 disposed at the developing position P1 by the rotation of the rotary developing device 104 is connected to the collecting port 2 provided in the transporting pipe 5.

From the gist of the present invention, however, the presence or absence of the storing portion is not particularly restricted. For example, there can be adopted a construction in which the transporting pipe 5 is constructed discretely from the rotary developing device 104 and the collecting port 2 opens only at one location corresponding to the developing position P1. Only the discharging path 4 communicating with the developing device 11 disposed at the developing position by the rotation of the rotary developing device 104 is connected to the collecting port 2 provided in the transporting pipe 5. Thus, when the developing device 11 is at the developing position P1, the discharging port 1 is located above the collecting port 2. Thereby, the developer discharged through the discharging port 1 falls to the collecting port 2 along the discharging path 4 by gravity. Thus, at the developing position P1, the excess developer in the developing device 11 can always be continuously discharged to the outside of the developing device 11 and therefore, particularly even when single-color image forming of high-density image is continued, the rotary operation of the rotary developing device 104 for discharging the developer is not required, and the amount of developer in the developing device 11 can be maintained within an allowable range. Thereby, the image productivity particularly during single-color continuous image forming can be obtained.

Reference is now had to FIGS. 13A, 13B and 13C and FIGS. 14A, 14B and 14C to describe in detail the operating mechanism of the shutter member 3 when the rotary developing device 104 is rotated which is most characteristic in the present embodiment. FIGS. 13A, 13B and 13C show the operating state of the shutter member 3 when during a continuous image forming operation, the rotary developing device 104 is at a development stop position. Also, FIGS. 14A, 14B and 14C show the operating state of the shutter member 3 when the rotary developing device 104 is at a home position waiting position as an example of a case where the rotary developing device 104 is at other rotation stop position (phase position) than the development stop position.

With reference to FIGS. 13A, 13B and 13C, the operating situation of the shutter member 3 during an ordinary continuous image forming operation will first be described with the developing device 11Y for yellow taken as an example. This operating situation is also similar with respect to the other developing devices, i.e., the developing device 11M for magenta and the developing device 11C for cyan.

When in FIGS. 13A, 13B and 13C, the developing device 11Y for yellow is at the developing position P1 (FIG. 13A), the positional relationship between the discharging port 1Y and the surface (upper surface) U of the developer in the developing device 11Y for yellow is such that the discharging port 1Y is located above (at a higher level than) the surface U of the developer. That is, at the developing position P1, the shutter member 3Y is pivotally moved by gravity and the discharging port 1Y is in its opened state. Thus, at the developing position P1, the two-component developer (developer) including a toner corresponding to an amount of toner consumed by image forming is supplied from the developer cartridge 6Y, whereby the amount of developer in the developing device 11Y for yellow is increased and the surface U of the developer becomes higher than the second developer circulating screw 7*b*, whereupon the excessive developer overflows from the discharging port 1Y and is discharged, and is once stored in the discharging path 4Y. Therefore, the surface U of the developer is maintained at the height of the second developer circulating screw 7*b*.

When the developing operation of the developing device 11Y for yellow is terminated, the rotary developing device 104 is rotated by about 120° in preparation for the developing operation by the developing device 11M for magenta which is the next color, and the developing device 11Y for yellow is moved to a position P2 (FIG. 13B). At this time, as shown, the shutter member 3Y is rotatively moved by gravity and the discharging port 1Y becomes closed. Also, in this state, the discharging port 1Y is below (at a lower level than) the surface U of the developer in the developing device 11Y for yellow, and the shutter member 3Y is pushed by the pressure of the developer in the developing device 11Y for yellow so as to bring the discharging port 1Y into its closed state. Therefore, it never happens that the developer in the developing device 11Y for yellow leaks out from the discharging port 1Y to the discharging path 4Y. The excess developer once collected in the discharging path 4Y falls into the collecting port 2 at this time, and is discharged to the outside of the rotary developing device 104 by the transporting pipe 5.

When the developing operation of the developing device 11M for magenta is terminated, the rotary developing device 104 is again rotated by about 120° in preparation for the developing operation by the developing device 11C for cyan which is the next color, and the developing device 11Y for yellow is moved to a position P3 (FIG. 13C). At this time, as shown, the discharging port 1Y is below (at a lower level than) the surface U of the developer in the developing device 11Y for yellow, and the shutter member 3Y still renders the discharging port 1Y closed by the pressure of the developer in the developing device 11Y for yellow and therefore, it never happens that the developer in the developing device 11Y for yellow leaks out from the discharging port 1Y to the storing discharging path 4Y. Even if the developer should leak out, it never happens owing to the action in the direction of gravity that the developer flows to the discharging path 4Y side.

Reference is now had to FIGS. 14A, 14B and 14C to describe the operating situation of the shutter member 3 of the developing device for each color at a home position waiting position, as an example of other stopping operation than the periodical and equal rotation stopping operation during continuous image forming, i.e., a case where the rotary developing device 104 is stopped at other position than the development stop position. This is a portion mentioned as the most characteristic point in the present embodiment.

FIG. 14A shows a stopped state at a waiting position whereat the developing device 11Y for yellow is located 60° on this side of the developing position P1. At this time, as shown in FIG. 14A, the discharging port 1Y of the developing device 11Y for yellow is below (at a lower level than) the surface U of the developer in the developing device 11Y for yellow, and the shutter member 3Y is operating so that the discharging port 1Y may be rendered closed by the pressure of the developer in the developing device 11Y for yellow. Therefore, it never happens that the developer in the developing device 11Y for yellow leaks out from the discharging port 1Y to the discharging path 4Y. Actually, it is conceivable that the discharging port 1Y is rendered opened by the shock of rotation, but even if the developer should leak out, it never happens owing to the action in the direction of gravity that the developer flows to the discharging path 4Y side.

Also, in the developing device 11*c* for cyan corresponding to a position rotated by 120° from the developing device 11Y for yellow, the shutter member 3C is operating so that the discharging port 1C may be rendered closed by gravity (FIG. 14B) Also, in this state, the discharging port 1C of the developing device 11C for cyan is below (at a lower level than) the surface U of the developer in the developing device 11C for cyan, and by the pressure of the developer in the developing device 11C for cyan, the shutter member 3C is pushed so as to render the discharging port 1C closed. Therefore, it never happens that the developer in the developing device 11C for cyan leaks out from the discharging port 1C to the discharging path 4C. Here, consider a case where the angle α of the surface E of the discharging port 1 at the developing position P1 which is adjacent to the developing device 11 is set so as to be 0°, that is, so that the surface E of the discharging port may be horizontal. In this case, the shutter member 3C tends to be closed by the pressure of the developer, but when this becomes unstable by the shock of rotation, the excess developer flows down to the discharging path 4C side.

The shutter member 3M of the developing device 11M for magenta corresponding to a position further rotated by 120° from the developing device 11C for cyan is operating so that the discharging port 1M may be rendered closed by gravity (FIG. 14C). Also, in this state, the discharging port 1M of the developing device 11M for magenta is below (at a lower level than) the surface U of the developer in the developing device 11M for magenta, and by the pressure of the developer in the developing device 11M for magenta, the shutter member 3M is pushed so as to render the discharging port 1M closed. Therefore, it never happens that the developer in the developing device 11M for magenta leaks out from the discharging port 1M to the discharging path 4M.

In FIGS. 14A, 14B and 14C, description has been made of the operating situation of the shutter member 3 at the home position waiting position, but even if besides, there is, for example, another stop position for the interchange of the toner cartridge, a similar effect can be displayed. Also, in the present embodiment, the developing devices 11 for the respective colors are substantially of the same construction. Accordingly, not only when as shown in FIGS. 14A, 14B and 14C, the developing devices 11 for the respective colors are disposed and stopped, but also even if any developing device 11 is stopped at any position, it is obvious that the shutter member 3 can likewise act.

As described above, only at the developing position P1, the shutter member 3 becomes opened and it never happens that the excess developer in the developing device 11 is unexpectedly discharged outwardly and therefore, even in a case where in order to discharge the developer, a rotating operation having a plurality of non-uniform stop positions (phase positions) including the development stopping position of the rotary developing device 104 is performed, the amount of developer in the developing device 11 can be stably maintained within an allowable range and therefore, a high image quality maintaining property is not lowered.

Also, in the present embodiment, the rotary developing device 104 adopts a three-color rotary construction using 120° rotation as the basis. Therefore, the surface (discharging port surface) E of the discharging port 1 which is adjacent to the shutter member 3 is inclined by 30° from a horizontal direction at the developing position P1, whereby there is suitably realized a construction which can easily cope with various rotation stop positions, and excellent high image quality maintaining stability is realized. In the present embodiment, by this excellent developer leakage preventing operation of the shutter member 3, the construction of the discharging path 4 for once storing the discharged developer therein can be made very simple, and this greatly contributes to a reduction in the costs of the rotary developing device 104, and further the image forming apparatus 100.

Besides, according to the present invention in which the surface E of the discharging port 1 which is adjacent to the shutter member 3 is inclined, not only in a three-color rotary having 120° rotation as the basis, but also in a construction having a plurality of rotation stop positions, an optimum angle of inclination based on the respective rotation stop position conditions thereof is selected, whereby it can be made easy to suitably cope with various rotation stop positions, and a developer discharge preventing characteristic can be stabilized.

As described above, even in a case where for example, besides such a development stopping position that the rotation stop position is at 120° each, there are other various stop positions such as a non-uniform developer cartridge interchange position, design is made such that the developer is always discharged only from a developing device 11 of stable posture which is at the developing position P1, and is not discharged at any other phase position and therefore, there is realized a developer discharging characteristic which is wide and very stable in coping width, and this contributes to the stability of a high quality of image.

Also, the rotation stop positions of the rotary developing device 104 are increased by a simple construction, whereby unexpected discharging of the developer can be prevented from being effected, and the storing chamber does not require any complicated constituent member and therefore, the necessity of the work of interchanging the developer can be eliminated by an inexpensive and stable construction, and an improvement in a maintenance property and a reduction in running cost can be realized.

Further describing, according to my studies, the deterioration of the developer by the long-term use thereof is due to two great causes, i.e., so-called toner-spent in which the toner adheres to the surface of the carrier, and the adherence of an extraneous additive in which the extraneous additive having drifted away from the toner adheres to the surface of the carrier. When the toner-spent and the adherence of the extraneous additive to the surface of the carrier occur, the surface area of the carrier which can charge the toner is decreased and therefore, the charging amount of the toner is reduced. Therefore, such image defects as an increase in image density and toner fog to the white portion, and the contamination of the image forming apparatus by the scattering of the toner occur.

According to the present embodiment, however, the developer including the deteriorated carrier is discharged out of the developing device 11 and is gradually replaced with a developer including a fresh carrier, whereby it becomes possible to stop the progress of the apparent deterioration of the carrier and stabilize the characteristic as the whole of the developer, and the stability of a high quality of image heightens.

On the other hand, as previously described, in recent years, a demand is heightening for increasing the stop positions of the rotary developing device 104, such as providing the home position waiting position and the developer cartridge interchange stop waiting position. According to the present embodiment, the developing device 11 disposed in the rotary developing device 104 is designed to have therein the discharging port 1 for discharging the excess developer therethrough, and the shutter member 3 near this discharging port 1, and design is made such that at the developing position P1 whereat the developing device 11 is opposed to the photosensitive drum 101, the surface E of the discharging port of the developing device 11 which is adjacent to the developing device 11 becomes an inclined surface. Thus, even if the rotation stop position of the rotary developing device 104 assumes any angle, an allowable value corresponding thereto becomes great, and a more reliable shutter operation becomes possible.

Therefore, even in a case where the rotary developing device 104 has a plurality of rotation stop positions as in a construction wherein the rotary developing device is stopped and made to wait at a home position whereat the developing sleeve 8 is not opposed to the photosensitive drum 101, or a construction wherein the rotary developing device is stopped and made to wait at a developer cartridge interchanging position, as is often seen in an image forming apparatus having a rotary type developing member, the shutter mechanism can be reliably operated and the shutter member 3 can suppress discharging. Consequently, even if the rotation stop positions are further increased, it will never happen that the discharging mechanism becomes unstable and it becomes difficult to maintain a high quality of image. Accordingly, even in a case where besides the development stop position visiting periodically and stably during a continuous image forming operation, unstable stop position behavior is exhibited like a home position waiting position visiting after the termination of a job, and a developer cartridge interchange stop waiting position in which the rotary developing device is stopped and waits only when the toner in the developer cartridge 6 has become little, a stable developer discharging characteristic can be obtained, and the setting of a condition therefore becomes easy, and this can be expected to greatly contribute to the shortening of a development period.

According to the present embodiment, even in a case where as described above, the rotary developing device 104 is stopped at a plurality of non-uniform stop positions, the reliably stable discharging and non-discharging characteristic of the developer is obtained irrespective of the rotation stop position, and it is possible to stably maintain the amount of developer in the developing device 11 within an allowable value and therefore, it never happens that a high image quality maintaining characteristic is lowered. In addition, even in a case where a mechanism member for once storing the excess developer therein is required, the complication and bulkiness of the mechanism member and the apparatus can be prevented and thus, without the complication and higher cost of the apparatus itself being caused, the maintenance property is improved such as the interchange of the developers during service maintenance becoming unnecessary.

As described above, according to the present embodiment, it is possible to obtain the high maintenance property that the interchange of the developers is unnecessary, and a high image quality maintaining characteristic excellent when the rotary developing device 104 is stopped at a plurality of non-uniform stop positions.

It should be understood that the construction of the multi-color image forming apparatus described in the present embodiment is exemplification for illustrating the present invention, and that the present invention is not restricted thereto, but various changes are possible within the scope of the present invention. For example, while in each of the above-described embodiments, the image forming apparatus adopts the intermediate transferring process, the present invention restricts the transferring process in no way, but may also adopt the process of successively superimposing and transferring toner images on a recording material borne on a transfer material bearing member, as is well known to those skilled in the art, or like process.

As described above, according to the above-described Embodiment 2, the high maintenance property that the interchange of the developers is unnecessary and high image productivity can be realized by a simple construction. Also, according to the present invention, even in a case where a rotary type developing member provided with a plurality of developing devices is stopped at a plurality of phase positions, it becomes possible to always stably maintain a high quality of image.

What is claimed is:

1. A developing apparatus comprising:

a plurality of developing devices, wherein each of said developing devices develops an electrostatic image formed on an image bearing member by a developer including a toner and a carrier;

a rotary member which rotates and supports a plurality of developing devices, said rotary member selectively positioning one of said plurality of developing devices at a developing position;

a plurality of discharging ports, wherein each of said discharging ports is provided in an associated one of said plurality of developing devices for discharging excess developer therethrough with a supply of the developer to said associated one of said plurality of developing devices located at said developing position;

a collecting pipe provided in said rotary member for collecting therethrough excess developer discharged from said plurality of discharging ports; and a plurality of communicating tubes, wherein each of said communicating tubes links together an associated one of said plurality of discharging ports and said collecting pipe, wherein when each of said developing devices is located at the developing position, and one of said plurality of discharging ports is located above said collecting pipe and an associated one of said plurality of communicating tubes is made to slope from said associated one of said plurality of discharging ports toward said collecting pipe.

2. A developing apparatus according to claim 1, wherein said collecting pipe is provided near a center of rotation of said rotary member.

3. A developing apparatus according to claim 2, wherein excess developer in said collecting pipe is transported outside of said rotary member.

4. A developing apparatus according to claim 1, further comprising a plurality opening and closing members, wherein each of said opening and closing members opens and closes an associated one of said plurality of discharging ports by gravity, wherein a surface of each of said discharging ports is inclined with respect to a horizontal plane so that when each of said developing devices is located at the developing position, an associated one of said plurality of discharging ports is opened by an associated one of said plurality of opening and closing members and so that when each of said plurality of developing devices is stopped at stop positions other than the developing position, an associated one of said plurality of discharging ports is closed by an associated one of said opening and closing members.

5. A developing apparatus comprising:

a developing device which develops an electrostatic image formed on an image bearing member with developer including toner and carrier at a developing portion;

a rotary member which rotates and supports said developing device, said rotary member positioning said developing device at the developing position;

supplying means which supplies developer to said developing device positioned at the developing position;

a discharging port which discharges excess developer exceeded in the case that developer is supplied to said developing device, from said developing device;

a collecting portion which collects the excess developer, said collecting portion being provided in said rotary member; and a developer conveying route in which the excess developer is transported from said discharging port to said collecting portion, wherein, in a case that said developing device is positioned at the developing position, said discharging port is positioned above said collecting portion.

6. A developing apparatus according to claim 5, wherein, in the case said developing device is positioned at the developing position, said conveying route is inclined toward said collecting portion downward from said discharging port.

7. A developing apparatus according to claim 6, wherein said conveying route is provided along a line connects between said discharging port and said collecting portion.

8. A developing apparatus according to claim 5, further comprising a plurality of developing devices, each of said plurality of developing devices include discharging portions, wherein said rotary member includes a plurality of said developer conveying routes corresponding to said plurality of developing devices.

9. A developing apparatus according to claim 8, wherein said collecting portion is provided near a center of rotation of said rotary member and collects excess developer from said plurality of developing devices.

10. A developing apparatus according to claim 9, wherein the excess developer in said collecting portion is transported to an outside of said rotary member.

* * * * *

UNITED STATES PATENT AND TRADEMARK OFFICE

CERTIFICATE OF CORRECTION

PATENT NO. : 6,987,940 B2
APPLICATION NO. : 10/421775
DATED : January 17, 2006
INVENTOR(S) : Masashige Tamura It is certified that error appears in the above-identified patent and that said Letters Patent is hereby corrected as shown below:

Title page,
Item [56], References Cited, FOREIGN PATENT DOCUMENTS,
"9/218575" should read -- 9-218575 --.

Column 4,
Line 36, "other rotation modes" should read -- rotation modes other --.

Column 17,
Line 1, "developing-devices" should read -- developing devices --.

Column 19,
Line 37, "after" should read -- after being --.

Column 21,
Line 37, "other" should read -- another --.

Column 23,
Line 21, "had" should read -- made --.

Column 24,
Line 33, "had" should read -- made --; and
Line 39, "other position" should read -- a position other --.

Column 28,
Line 42, "plurality" should read -- plurality of --.

Signed and Sealed this

Eleventh Day of July, 2006

JON W. DUDAS
*Director of the United States Patent and Trademark Office*